US009925806B2

(12) United States Patent
Kim et al.

(10) Patent No.: US 9,925,806 B2
(45) Date of Patent: Mar. 27, 2018

(54) RECORDING PAPER CUTTING DEVICE AND PRINTING DEVICE

(71) Applicant: BIXOLON CO., LTD., Seongnam-si, Gyeonggi-do (KR)

(72) Inventors: Jin Gwan Kim, Yongin-si (KR); Jin Kook Kim, Suwon-si (KR)

(73) Assignee: BIXOLON CO., LTD., Seongnam-si (KR)

( * ) Notice: Subject to any disclaimer, the term of this patent is extended or adjusted under 35 U.S.C. 154(b) by 0 days.

(21) Appl. No.: 15/389,212

(22) Filed: Dec. 22, 2016

(65) Prior Publication Data

US 2017/0182806 A1 Jun. 29, 2017

(30) Foreign Application Priority Data

Dec. 23, 2015 (KR) ..... 10-2015-0184547
Dec. 23, 2015 (KR) ..... 10-2015-0184549
Dec. 23, 2015 (KR) ..... 10-2015-0184550

(51) Int. Cl.

| | |
|---|---|
| ***B26D 1/02*** | (2006.01) |
| ***B41J 11/66*** | (2006.01) |
| ***B41J 11/70*** | (2006.01) |
| ***B26D 1/01*** | (2006.01) |
| ***B41J 15/04*** | (2006.01) |

(Continued)

(52) U.S. Cl.

CPC ..... *B41J 11/70* (2013.01); *B26D 1/015* (2013.01); *B41J 15/042* (2013.01); *B26D 2001/0053* (2013.01); *B41J 2/32* (2013.01)

(58) Field of Classification Search

CPC ..... B41J 11/66; B41J 11/663; B41J 11/666; B41J 11/68; B41J 11/70; B26D 1/01; B26D 1/02; B26D 1/04; B26D 1/08; B26D 1/09; B26D 1/10; B26D 1/11

See application file for complete search history.

(56) References Cited

U.S. PATENT DOCUMENTS

| | | | |
|---|---|---|---|
| 8,152,394 | B2 | 4/2012 | Kohira et al. |
| 8,277,134 | B2 | 10/2012 | Kawaguchi |
| 8,783,984 | B2 | 7/2014 | Kim et al. |

(Continued)

FOREIGN PATENT DOCUMENTS

| | | | |
|---|---|---|---|
| JP | 2005-007802 | A | 1/2005 |
| JP | 2005-053093 | A | 3/2005 |

(Continued)

*Primary Examiner* — Huan Tran

(74) *Attorney, Agent, or Firm* — Maschoff Brennan

(57) ABSTRACT

A recording paper cutting device enables cutting of a boundary between a first area of a recording paper and a second area of the recording paper placed at an upstream side of the first area, so that the first area is separately discharged from the second area after the first area is printed. The recording paper cutting device includes first and second cutting parts. The first cutting part of the second cutting parts moves in an approaching or departing direction so that the boundary is cut. The first cutting part includes a first cutting surface inclined by a first angle in the departing direction from the second cutting part and a second cutting surface that extends from the first cutting surface and is inclined by a second angle, which is smaller than the first angle, in the departing direction from the second cutting part.

20 Claims, 23 Drawing Sheets

(51) Int. Cl.

| | |
|---|---|
| *B26D 1/00* | (2006.01) |
| *B41J 2/32* | (2006.01) |

(56) References Cited

U.S. PATENT DOCUMENTS

| | | | | |
|---|---|---|---|---|
| 9,393,817 | B2 | 7/2016 | Murata | |
| 2012/0027496 | A1* | 2/2012 | Mochida | B26D 1/0006 400/621 |

FOREIGN PATENT DOCUMENTS

| | | | |
|---|---|---|---|
| JP | 2010-099852 | A | 5/2010 |
| JP | 2015-168178 | A | 9/2015 |
| KR | 10-0912461 | B1 | 8/2009 |
| KR | 10-2009-0117620 | A | 11/2009 |
| KR | 10-2009-0131630 | A | 12/2009 |

* cited by examiner (a)

(b)

(a)

(b)

RECORDING PAPER CUTTING DEVICE AND PRINTING DEVICE

CROSS-REFERENCE TO RELATED APPLICATION

This application claims priority to and the benefit of Korean Patent Application Nos. 10-2015-0184547, filed on Dec. 23, 2015, 10-2015-0184549, filed on Dec. 23, 2015 and 10-2015-0184550, filed on Dec. 23, 2015 the disclosure of which is incorporated herein by reference in its entirety.

BACKGROUND

1. Field of the Invention

The present invention relates to a recording paper cutting device and a printing device, and more particularly, to a recording paper cutting device capable of preventing degradation of recording paper cutting performance due to an adhesive applied on a recording paper, and a printing device.

2. Discussion of Related Art

A thermal printer is a type of a non-impact printer which uses a special recording paper that reacts to heat and applies heat to a recording paper using a printer head to develop color to show a letter or an image.

That is, due to its ability to smoothly print a letter or realize colorful graphics without using a toner, ink, or the like, a thermal printer is suitably used for printing various types of labels, receipts, tickets, or the like.

A typical thermal printer includes a cutting part configured to cut or perforate a printed recording paper and, in general, automatically cuts or perforates a recording paper when printing is finished.

Here, recording papers used for a thermal printer includes a recording paper having an adhesive applied on one surface thereof. When such recording papers are used, a phenomenon in which an adhesive is accumulated on a cutting part in a repeated process of cutting or perforating the recording papers occurs.

Such a phenomenon leads to degradation of cutting performance and causes inconvenience to a user.

Also, when the recording papers described above are used, there is a problem in that, after the recording papers are cut by the cutting part, recording papers disposed at an upstream side are attached to the cutting part and are not normally fed.

Also, a typical thermal printer inevitably has a predetermined space between a printing part and a cutting part, and there is a problem in that recording papers placed between the printing part and the cutting part cannot be printed due to the predetermined space.

SUMMARY OF THE INVENTION

An aspect of the present invention is to provide a recording paper cutting device that prevents an adhesive from being accumulated on a cutting part in a repeated process of cutting or perforating recording papers, realizes normal feeding of recording papers, and maximizes economic feasibility of recording papers, and a printing device.

According to an embodiment of the present invention, a recording paper cutting device for cutting a boundary between a first area of a recording paper and a second area of the recording paper placed at an upstream side of the first area so that the first area is separately discharged from the second area after the first area is printed with a first piece of information includes a first cutting part and a second cutting part, wherein at least one of the first cutting part and the second cutting part moves in an approaching direction or a departing direction so that the boundary is cut, and the first cutting part includes a first cutting surface formed to be inclined by a first angle in the departing direction from the second cutting part and a second cutting surface configured to extend from the first cutting surface and formed to be inclined by a second angle, which is smaller than the first angle, in the departing direction from the second cutting part.

According to an embodiment of the present invention, in the recording paper cutting device, a width of the second cutting surface in the departing direction from the second cutting part may be larger than a width of the first cutting surface in the departing direction from the second cutting part.

According to an embodiment of the present invention, in the recording paper cutting device, a width of the second cutting surface in a feeding direction of the first area may be larger than a width of the first cutting surface in the feeding direction of the first area.

According to an embodiment of the present invention, in the recording paper cutting device, the first cutting part may move in the approaching direction to the second cutting part so that the boundary is cut and may be obliquely moved in the approaching direction to the second cutting part due to contact with the second cutting part.

According to an embodiment of the present invention, the recording paper cutting device may further include a pressing force providing part configured to provide a pressing force to the first cutting part so that the first cutting part is obliquely moved in the approaching direction to the second cutting part while in contact with the second cutting part.

According to an embodiment of the present invention, the pressing force providing part of the recording paper cutting device may include a contact part configured to come into contact with the first cutting part and an elastic part configured to provide a pressing force so that the contact part is in contact with the first cutting part. The elastic part may be elastically deformed when the first cutting part is in contact with the second cutting part and, when the contact is released, may maintain the contact between the contact part and the first cutting part by a restoring force caused by the elastic deformation.

According to an embodiment of the present invention, the recording paper cutting device may further include a driving force providing part configured to provide a driving force for moving the first cutting part, and a driving force transmitting part configured to rotate by the driving force so that the driving force is transmitted to the first cutting part. The driving force transmitting part may include an eccentric part that is eccentrically protruding, and the first cutting part may include a deviating part formed to be deviated from a center to accommodate the eccentric part so that the first cutting part is moved in the approaching direction to or the departing direction from the second cutting part by rotation of the eccentric part. The recording paper cutting device may further comprise a stiffness reinforcing part mounted on the eccentric part and accommodated in the deviating part to reinforce a stiffness of the eccentric part.

According to an embodiment of the present invention, the recording paper cutting device may further include a movement detection part configured to detect movement of the first cutting part to enable information on whether the boundary is cut by an interaction between the first cutting part and the second cutting part to be acquired.

According to an embodiment of the present invention, a normal vector of the first cutting surface of the recording paper cutting device may intersect with a normal vector of the second cutting surface in a space corresponding to an upstream side of a position at which the boundary is cut.

According to another embodiment of the present invention, a recording paper cutting device for cutting a boundary between a first area of a recording paper and a second area of the recording paper placed at an upstream side of the first area so that the first area is separately discharged from the second area after the first area is printed with a first piece of information includes a first cutting part and a second cutting part, wherein at least one of the first cutting part and the second cutting part moves in an approaching direction or a departing direction so that the boundary is cut, and the first cutting part includes a first cutting surface configured to increase a gap between the first area and the second area by a first rate of increase and a second cutting surface configured to increase the gap by a second rate of increase depending on a degree in which the first cutting part is moved in the approaching direction to the second cutting part.

According to another embodiment of the present invention, the second rate of increase of the recording paper cutting device may be smaller than the first rate of increase.

According to still another embodiment of the present invention, a printing device includes a main body part configured to provide a predetermined inner space, a printing part configured to print a first area of a recording paper disposed in the inner space with a first piece of information, and a cutting part configured to cut a boundary between the first area of the recording paper and a second area of the recording paper placed at an upstream side of the first area so that the first area is separately discharged from the second area, wherein the cutting part includes a first cutting part and a second cutting part, at least one of the first cutting part and the second cutting part moves in an approaching direction or a departing direction so that the boundary is cut, and the first cutting part includes a first cutting surface configured to increase a gap between the first area and the second area by a first rate of increase and a second cutting surface configured to increase the gap by a second rate of increase depending on a degree in which the first cutting part is moved in the approaching direction to the second cutting part.

According to still another embodiment of the present invention, the second rate of increase of the printing device may be smaller than the first rate of increase.

According to still another embodiment of the present invention, the first cutting surface of the printing device may be formed to be inclined by a first angle in the departing direction from the second cutting part, and the second cutting surface may be formed to be inclined by a second angle, which is smaller than the first angle, in the departing direction from the second cutting part.

According to still another embodiment of the present invention, in the printing device, a width of the second cutting surface in the departing direction from the second cutting part may be larger than a width of the first cutting surface in the departing direction from the second cutting part.

According to still another embodiment of the present invention, in the printing device, a width of the second cutting surface in a feeding direction of the first area may be larger than a width of the first cutting surface in the feeding direction of the first area.

According to still another embodiment of the present invention, in the printing device, the first cutting part may move in the approaching direction to the second cutting part so that the boundary is cut and may be obliquely moved in the approaching direction to the second cutting part due to contact with the second cutting part.

According to still another embodiment of the present invention, the printing device may further include a pressing force providing part configured to provide a pressing force to the first cutting part so that the first cutting part is obliquely moved in the approaching direction to the second cutting part while in contact with the second cutting part.

According to still another embodiment of the present invention, the pressing force providing part of the printing device may include a contact part configured to come into contact with the first cutting part and an elastic part configured to provide a pressing force so that the contact part is in contact with the first cutting part. The elastic part may be elastically deformed when the first cutting part is in contact with the second cutting part and, when the contact is released, may maintain the contact between the contact part and the first cutting part by a restoring force caused by the elastic deformation.

According to still another embodiment of the present invention, the printing device may further include a driving force providing part configured to provide a driving force for moving the first cutting part, and a driving force transmitting part configured to rotate by the driving force so that the driving force is transmitted to the first cutting part. The driving force transmitting part may include an eccentric part that is eccentrically protruding, and the first cutting part may include a deviating part formed to be deviated from a center to accommodate the eccentric part so that the first cutting part is moved in the approaching direction to or the departing direction from the second cutting part by rotation of the eccentric part. The printing device may further comprise a stiffness reinforcing part mounted on the eccentric part and accommodated in the deviating part to reinforce a stiffness of the eccentric part.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
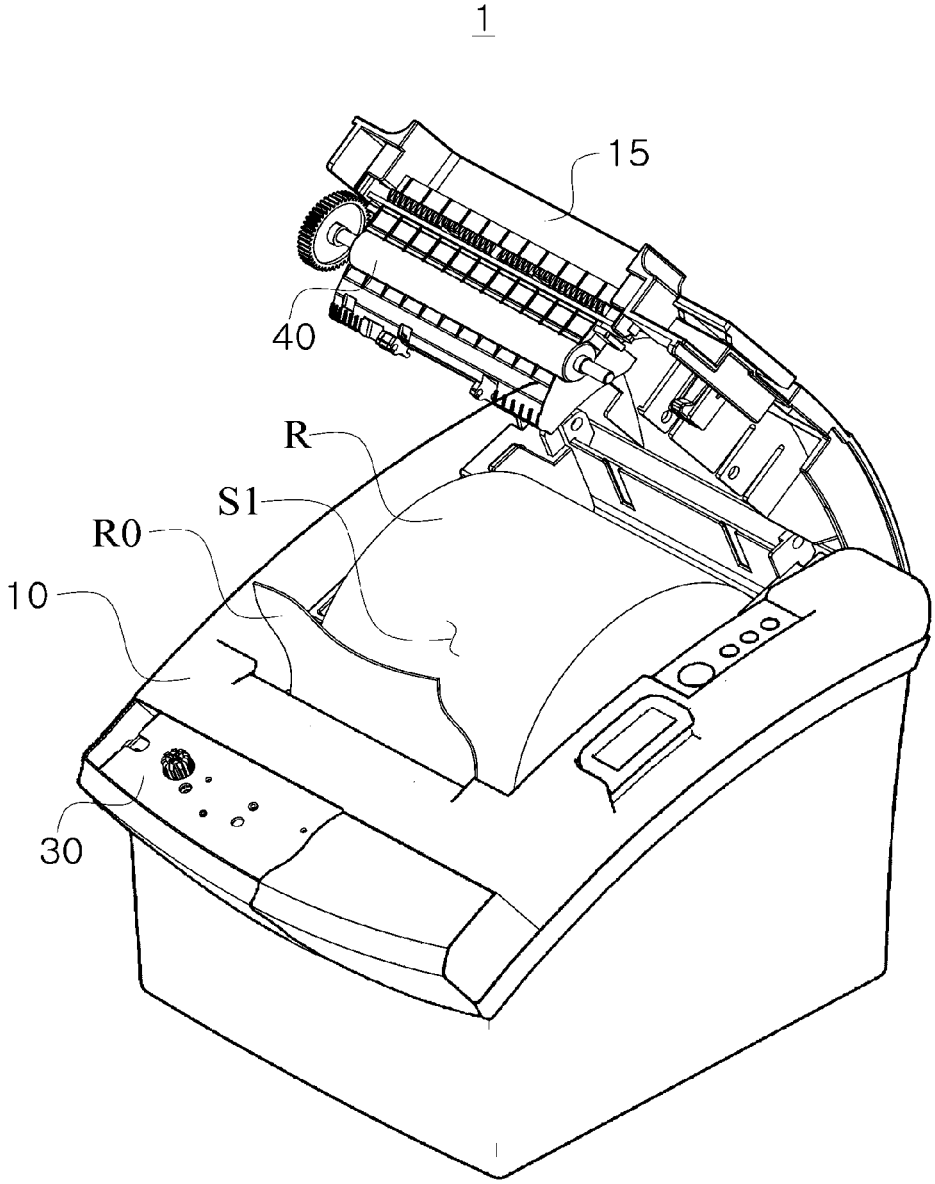
FIG. 1 is a schematic perspective view of a printing device according to the present invention.

Hereinafter, specific embodiments of the present invention will be described in detail with reference to the accompanying drawings. However, the spirit of the present invention is not limited to the embodiments that are disclosed below, and one of ordinary skill in the art who understands the spirit of the present invention may easily propose other less advanced inventions or other embodiments included within the scope of the spirit of the present invention by adding, changing, or deleting an element within the scope of the same spirit. However, such other inventions or embodiments should also be construed as belonging to the scope of the spirit of the present invention.

Also, elements having the same function within the scope of the same spirit illustrated in the drawings of each of the embodiments will be described using like reference numerals.

Figure 2:
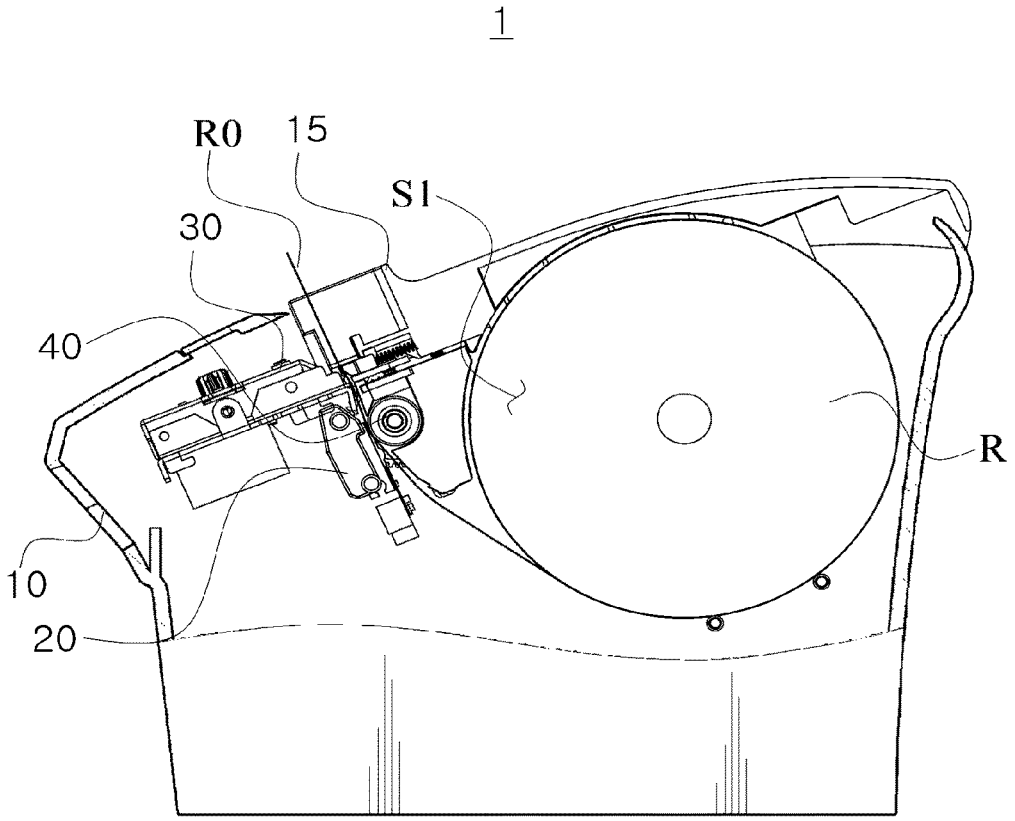
FIG. 2 is a view of an inner configuration of the printing device according to the present invention.

FIG. 1 is a schematic perspective view of a printing device according to the present invention, and FIG. 2 is a view of an inner configuration of the printing device according to the present invention.

Referring to FIGS. 1 and 2, a printing device 1 according to the present invention is an apparatus that may be suitably used for printing various types of labels, receipts, tickets, or the like. For example, the printing device 1 may be a thermal printer.

A thermal printer may be a printer capable of using a special recording paper that reacts to heat and showing a letter or an image by applying heat to a recording paper using a thermal head and developing color on the recording paper. Also, recording papers used for the thermal printer may be a recording paper having an adhesive applied on one surface thereof.

The printing device 1 may include a main body part 10 configured to provide a predetermined inner space S1, a printing part 20 configured to print a recording paper with a predetermined piece of information, and a cutting part 30 configured to cut a portion of the recording paper on which printing is finished.

Also, the printing device 1 may further include a cover part 15 movably, i.e., rotatably, connected to the main body part 10 to enable opening and closing of the inner space S1 to be adjusted and a feeding part 40 configured to feed a recording paper R0 provided in the form of a roll paper R disposed in the inner space S1.

Hereinafter, the above elements will be described in detail.

The main body part 10 may provide an exterior of the printing device 1 according to the present invention, and a shape of the main body part 10 is not limited.

In other words, the shape of the main body part 10 may be changed in various ways depending on a usage environment of the printing device 1 according to the present invention.

The printing part 20 is an element capable of printing the recording paper R0, provided in the form of the roll paper R disposed in the inner space S1, with a predetermined piece of information. When the printing device 1 according to the present invention is a thermal printer, the printing part 20 may be a thermal head.

Because a thermal head is a known art, a detailed description thereof will be omitted.

The feeding part 40 may be mounted on the cover part 15 and may be moved by interlocking with rotation of the cover part 15 with respect to the main body part 10. When the printing device 1 according to the present invention is a thermal printer, the feeding part 40 may be a type of a rotatable roller.

When the inner space S1 is closed by the cover part 15, the feeding part 40 may be adjacent to the printing part 20 and enable the predetermined piece of information to be printed by the printing part 20.

Figure 3:
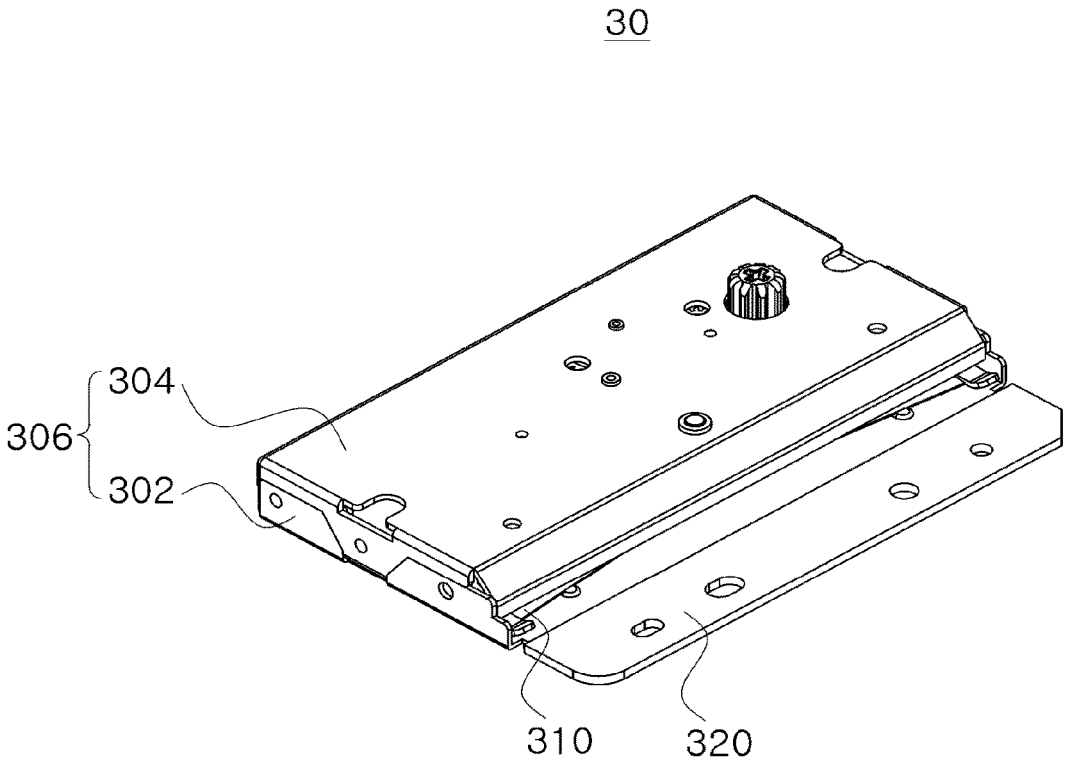
FIG. 3 is a schematic perspective view of a recording paper cutting device provided in the printing device according to the present invention.
Figure 4:
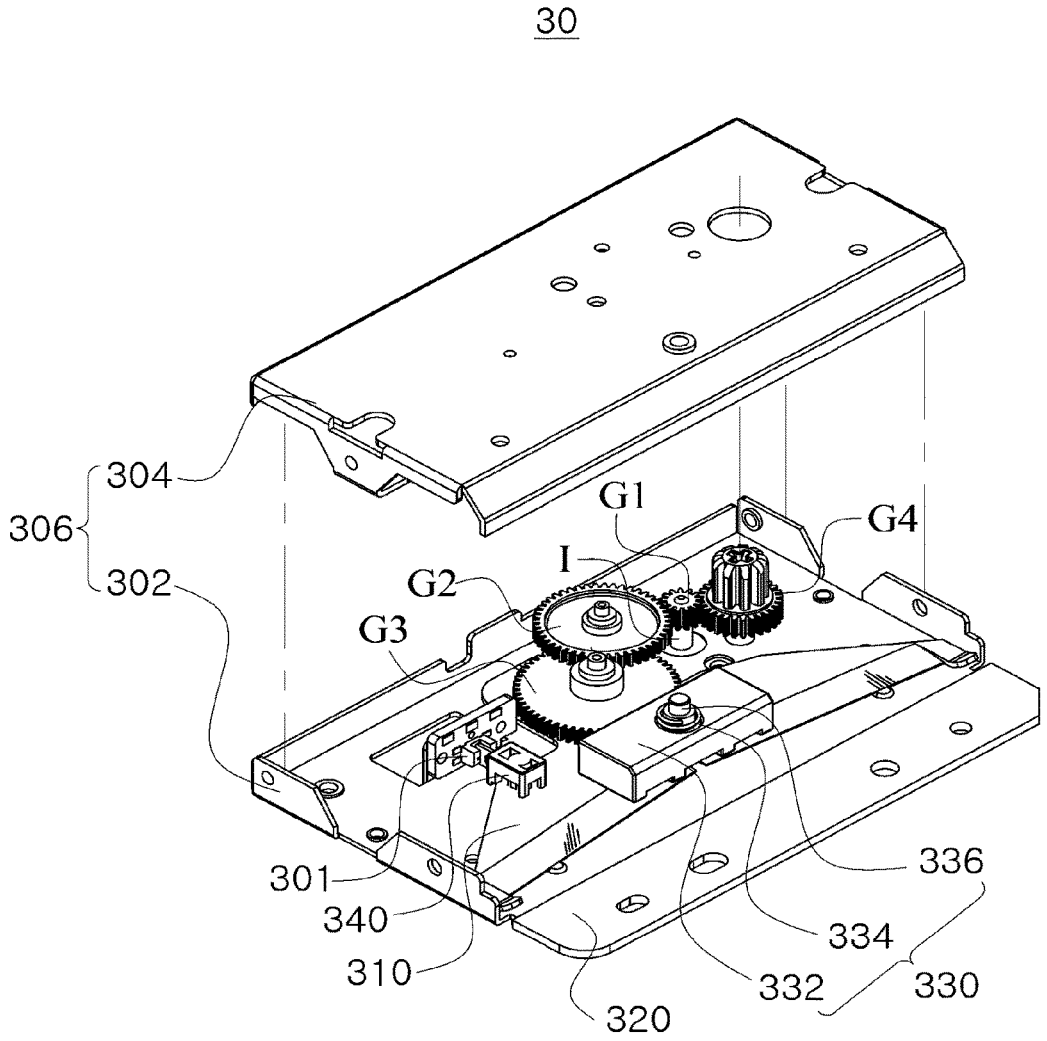
FIG. 4 is a view illustrating an inner configuration of the recording paper cutting device provided in the printing device according to the present invention.

FIG. 3 is a schematic perspective view of a recording paper cutting device provided in the printing device according to the present invention, and FIG. 4 is a view illustrating an inner configuration of the recording paper cutting device provided in the printing device according to the present invention.

Figure 5:
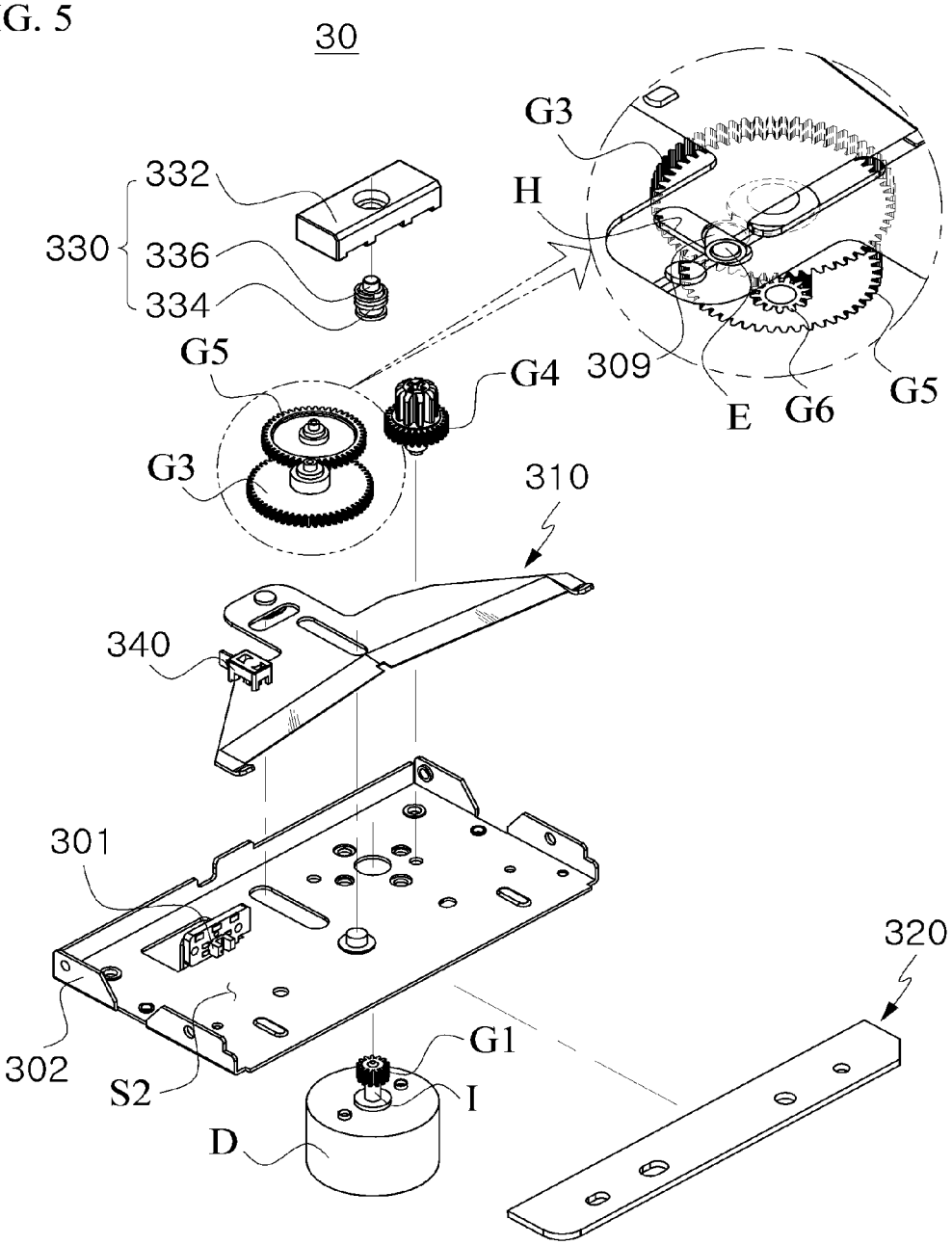
FIG. 5 is a schematic exploded perspective view of the recording paper cutting device provided in the printing device according to the present invention.
Figure 6:
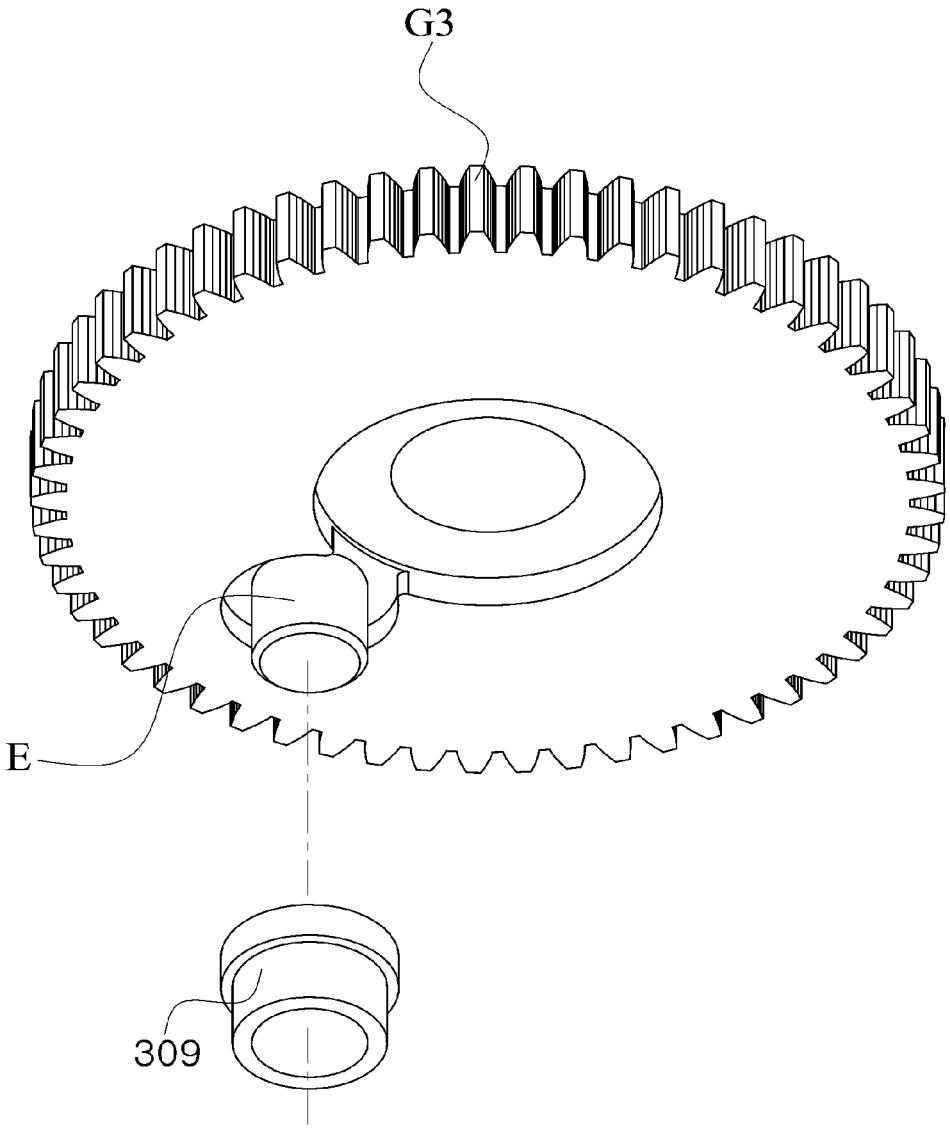
FIG. 6 is a schematic perspective view illustrating a third gear provided in the recording paper cutting device of FIG. 5.

Also, FIG. 5 is a schematic exploded perspective view of the recording paper cutting device provided in the printing device according to the present invention, and FIG. 6 is a schematic perspective view illustrating a third gear provided in the recording paper cutting device of FIG. 5.

Prior to giving a detailed description of the cutting part 30, it should be noted that a cutting part used in a printing device may be mainly divided into two types.

The first is a guillotine type, and the second is a scissors type.

Hereinafter, a description will be given by assuming that the cutting part 30 according to the present invention is the guillotine type. However, it should be noted that a scissors type cutting part may also be employed as the cutting part 30 within the scope of a non-contradictory spirit.

Referring to FIGS. 3 to 6, the printing device 1 according to the present invention may include the cutting part 30 configured to cut a portion of the recording paper R0, on which printing is finished, from the remaining portion thereof.

The cutting part 30 will be described in detail. Because the cutting part 30 is a single element and may be an independent object for transaction, the cutting part 30 will be defined as a recording paper cutting device 30 and described below.

The recording paper cutting device 30 may be an element capable of cutting a boundary between a first area R1 (see FIG. 7) of the recording paper R0 provided in the form of the roll paper R and a second area R2 (see FIG. 7) of the recording paper R0 placed at an upstream side with respect to the first area R1 so that, after the first area R1 is printed with a first piece of information and is fed toward a downstream side by the feeding part 40, the first area R1 printed with the first piece of information is separately discharged from the second area R2.

Here, the first area R1 may be a most downstream area of the recording paper R0 provided in the form of the roll paper R, and the second area R2 may be an area disposed upstream than the first area R1.

Meanwhile, an upstream side and a downstream side may be defined as the following. With respect to the first area R1 of the recording paper R0 provided in the form of the roll paper R, a spot through which the first area R1 passes first may be defined as an upstream side, and a spot through which the first area R1 that has passed through the upstream side subsequently passes may be defined as a downstream side.

The recording paper cutting device 30 may include a first cutting part 310 and a second cutting part 320 configured to cut the boundary between the first area R1 and the second area R2, that pass through a gap between the first cutting part 310 and the second cutting part 320, by essentially moving in an approaching direction to or a departing direction from each other.

For example, at least one of the first cutting part 310 and the second cutting part 320 may move in the approaching direction or the departing direction so that the boundary is cut.

For example, the first cutting part 310 may be a movable cutter that is movable toward the second cutting part 320, and the second cutting part 320 may be a fixed cutter with respect to the first cutting part 310.

However, the second cutting part 320 may also be implemented by a movable cutter, and the first cutting part 310 may also be implemented by a fixed cutter. Also, both of the first cutting part 310 and the second cutting part 320 may be implemented by a movable cutter.

Hereinafter, a description will be given by assuming that the first cutting part 310 is a movable cutter and the second cutting part 320 is a fixed cutter.

The first cutting part 310 may be movably disposed in a case 306 mounted in the inner space S1 provided by the main body part 10, and the case 306 may include a first case 302 and a second case 304 so that an installation space S2 for installing the first cutting part 310 is provided.

The second case 304 may be a type of a cover member for the first case 302, and all known methods may be applied as a method of fastening the second case 304 to the first case 302.

Together with the first cutting part 310, one or more other elements may be disposed in the first case 302. Specifically, one or more driving force transmitting parts G configured to rotate by a driving force providing part D configured to provide a driving force for moving the first cutting part 310 may be disposed in the first case 302.

The driving force providing part D may be a type of a step motor, and a rotating shaft I of the driving force providing part D may be disposed in the installation space S2.

A first gear G1 may be mounted on the rotating shaft I, and the first gear G1 may rotate by interlocking with rotation of the rotating shaft I.

The one or more driving force transmitting parts G configured to rotate by the driving force provided by the driving force providing part D so that the driving force is transmitted to the first cutting part 310 may be connected to the first gear G1.

The one or more driving force transmitting parts G may be a gear assembly including a plurality of gears and may include a second gear G2 configured to be engaged with the first gear G1 and a third gear G3 configured to be engaged with the second gear G2.

Here, the second gear G2 may include a fifth gear G5 configured to be engaged with the first gear G1 and a sixth gear G6 configured to be engaged with the third gear G3.

The fifth gear G5 and the sixth gear G6 may have different diameters. For example, the diameter of the fifth gear G5 may be larger than the diameter of the sixth gear G6.

Differences in diameters of the first gear G1, the fifth gear G5, the sixth gear G6, and the third gear G3 are factors that may cause a number of rotations of the third gear G3 due to the driving force provided by the driving force providing part D to be different from a number of rotations of the first gear G1 due to the driving force. Finally, the diameters may be properly changed in consideration of a reduction gear ratio related to a degree of movement of the first cutting part 310.

Here, the degree of movement of the first cutting part 310 may be related to a rotational angle of the third gear G3. To realize movement of the first cutting part 310, the third gear G3, which is one of the one or more driving force transmitting parts may include an eccentric part E eccentrically protruding from a lower surface.

Also, the first cutting part 310 may include a deviating part H formed to be deviated from a center to accommodate the eccentric part E and may be moved in the approaching direction to or the departing direction from the second cutting part 320 by rotation of the eccentric part E.

Specifically, when the third gear G3 rotates by the driving force provided by the driving force providing part D, the eccentrically protruding eccentric part E also rotates. Thus, the first cutting part 310 moves in a straight line due to the deviating part H in which the eccentric part E is accommodated by passing therethrough.

A stiffness reinforcing part 309 configured to reinforce a stiffness of the eccentric part E may be mounted on the eccentric part E. Actually, the stiffness reinforcing part 309 mounted on the eccentric part E is inserted into the deviating part H.

Consequently, when the eccentric part E rotates due to the rotation of the third gear G3, the stiffness reinforcing part 309 directly comes into contact with the deviating part H such that durability of the eccentric part E may be improved.

Figure 9:
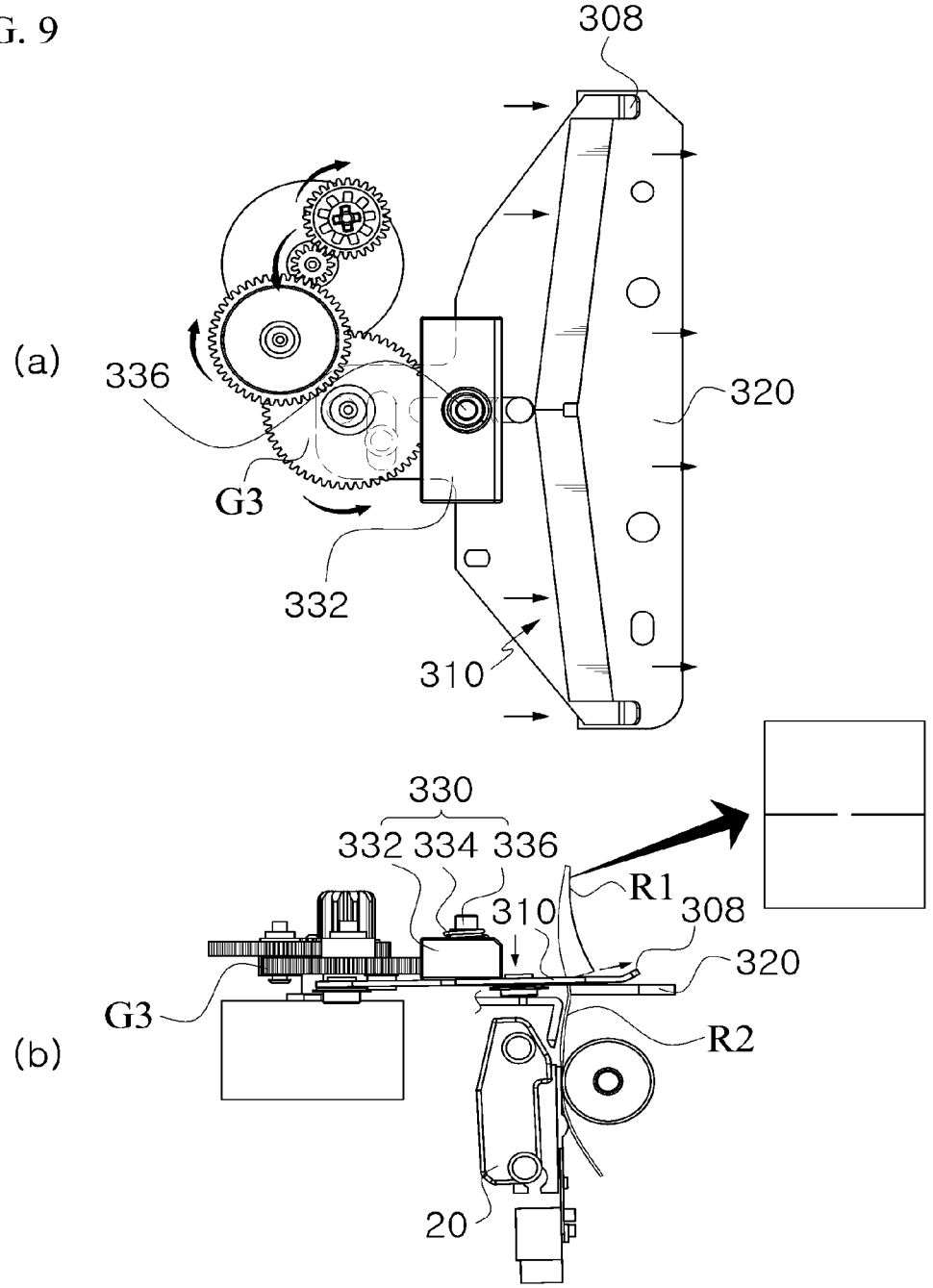
Figure 10:
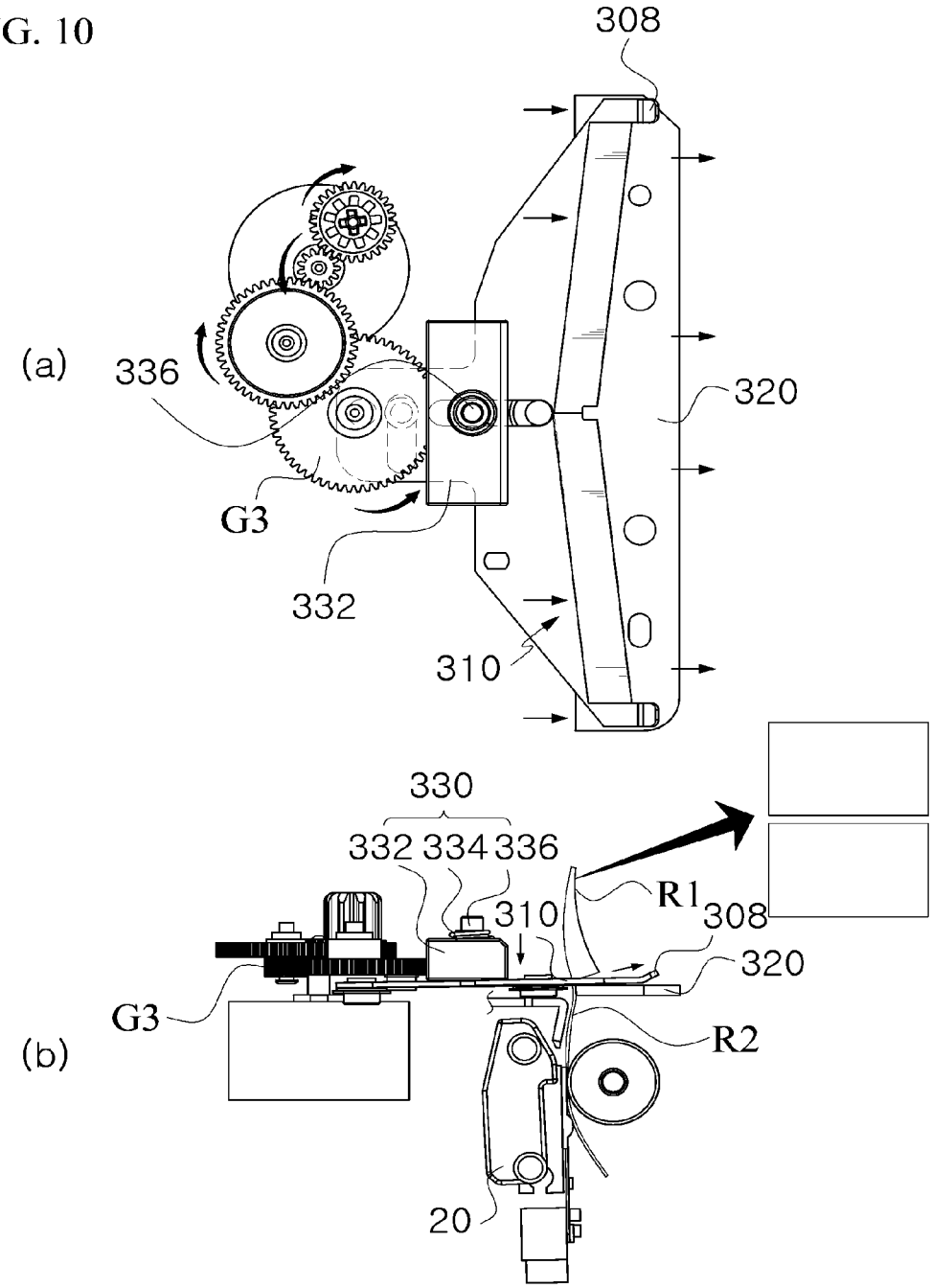
Figure 11:
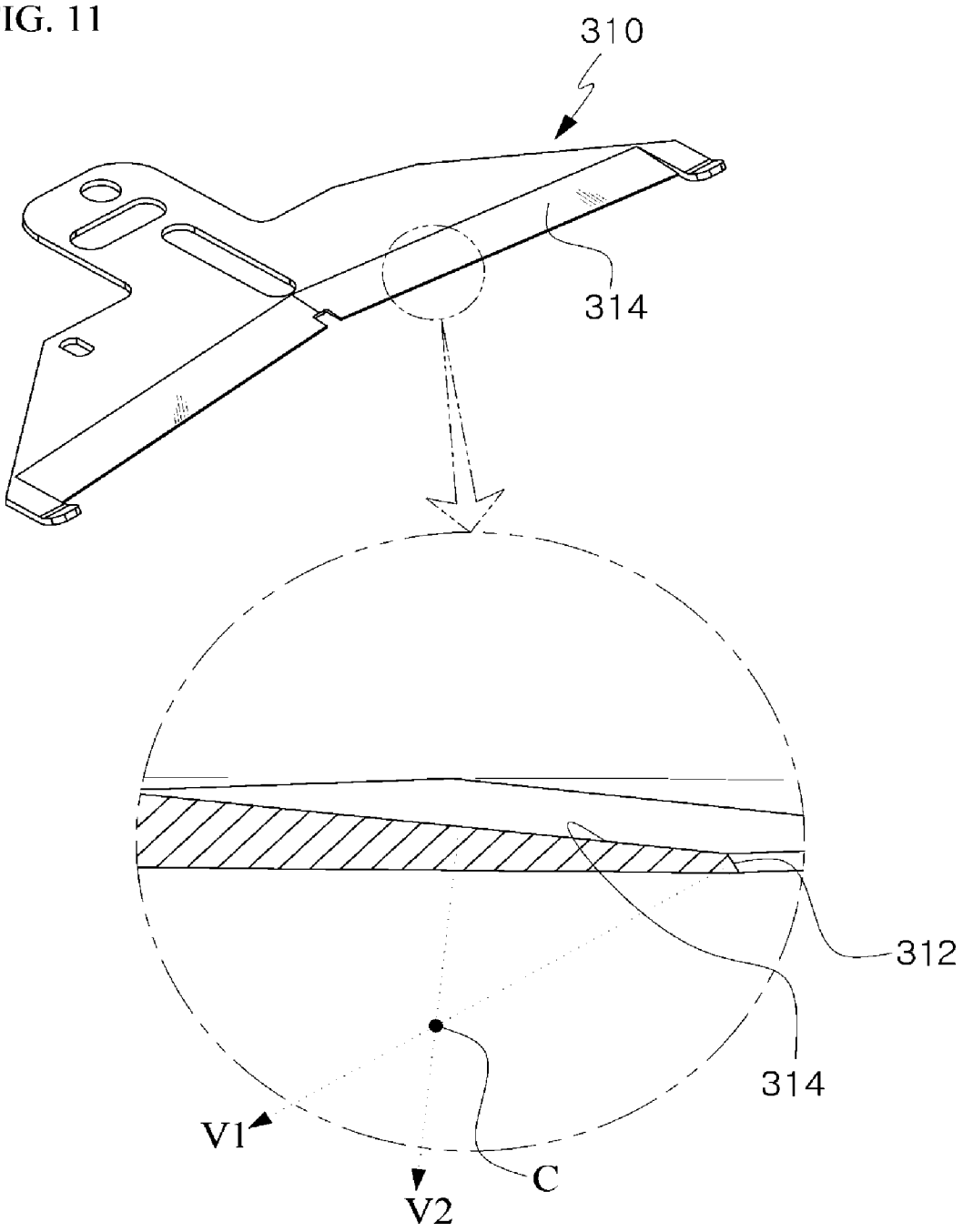
FIG. 11 is a schematic perspective view illustrating a first cutting part of the recording paper cutting device provided in the printing device according to the present invention.

FIGS. 7 to 10 are views for describing a process in which a recording paper is cut by the recording paper cutting device provided in the printing device according to the present invention, and FIG. 11 is a schematic perspective view illustrating a first cutting part of the recording paper cutting device provided in the printing device according to the present invention.

The first cutting part 310 may move in the approaching direction to the second cutting part 320 within the installation space S2 of the first case 302 by the rotation of the third gear G3 and cut the boundary between the first area R1 and the second area R2 of the recording paper R0 as illustrated in FIG. 10. However, the first cutting part 310 may also form a perforated line at the boundary between the first area R1 and the second area R2 as illustrated in FIG. 9.

Whether the boundary between the first area R1 and the second area R2 is cut or a perforated line is formed at the boundary may be determined according to a degree of movement of the first cutting part 310 toward the second cutting part 320. This will be described in detail below.

Figure 7:
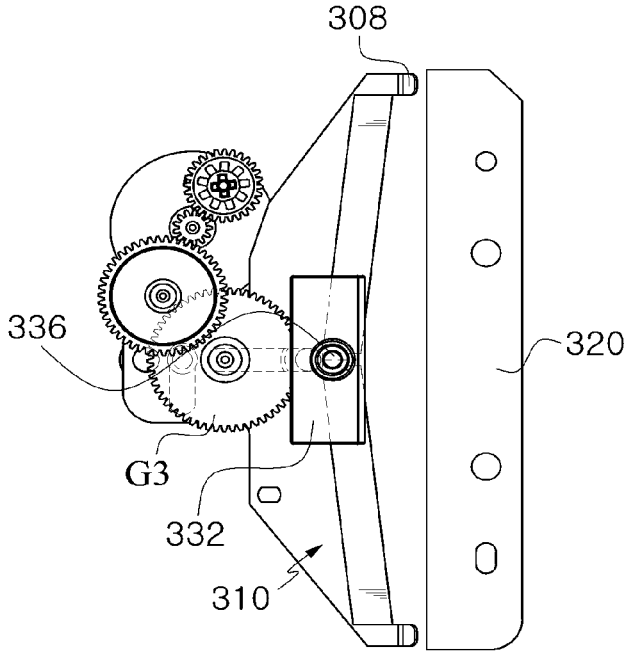
FIGS. 7(*a*), 7(*b*) to 10(*a*), 10(*b*) are views for describing a process in which a recording paper is cut by the recording paper cutting device provided in the printing device according to the present invention.
Figure 7:
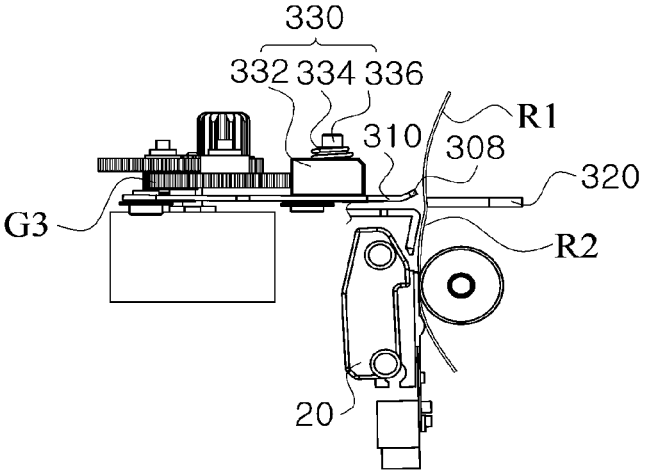

First, referring to FIG. 7, the first cutting part 310 may have a substantially V-like shape. Thus, when the first cutting part 310 approaches toward the second cutting part 320, the first cutting part 310 cuts the first area R1 of the recording paper R0 from both ends in a width direction toward a center.

A cutting guide part 308 formed to be inclined upward in the approaching direction to the second cutting part 320 may be formed at both ends of the first cutting part 310. The cutting guide part 308 may be an element that comes into contact with the second cutting part 320 first when the first cutting part 310 approaches toward the second cutting part 320.

Figure 8:
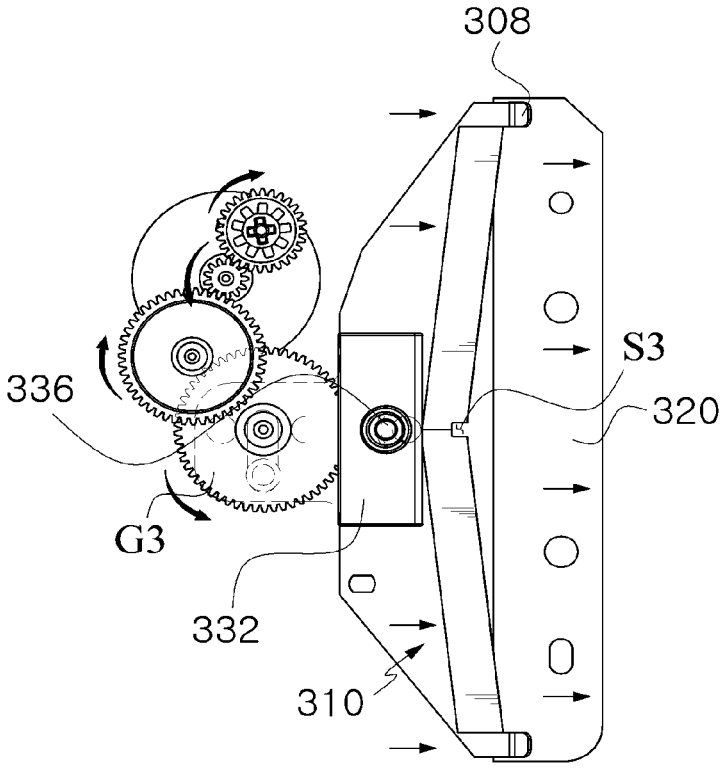
Figure 8:
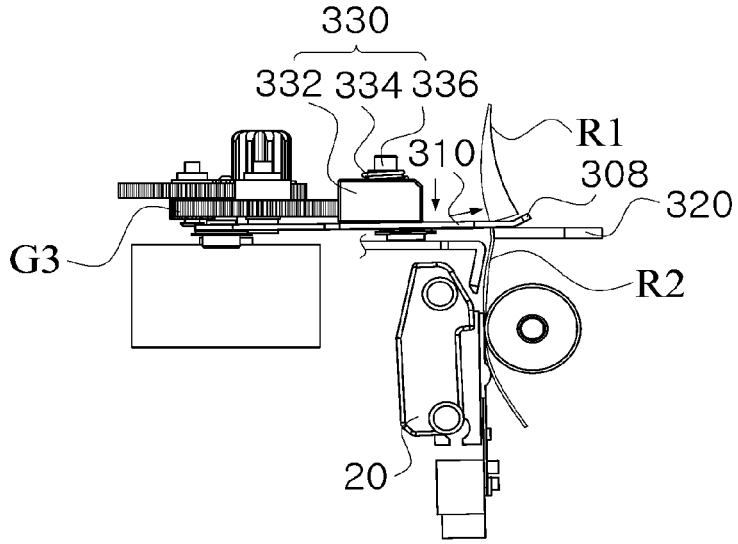

Here, as illustrated in FIG. 8, the first cutting part 310 may be obliquely moved upward in the approaching direction to the second cutting part 320 due to contact with the second cutting part 320 when the first cutting part 310 approaches toward the second cutting part 320 to cut the boundary between the first area R1 and the second area R2. This is because a lower surface of the first cutting part 310 is disposed lower than an upper surface of the second cutting part 320.

In other words, when the first cutting part 310 approaches toward the second cutting part 320, the cutting guide part 308 first comes into contact with the second cutting part 320. Thus, the first cutting part 310 is naturally moved upward obliquely along the upper surface of the second cutting part 320.

Meanwhile, the recording paper cutting device 30 according to the present invention may include a pressing force providing part 330 configured to provide a pressing force to the first cutting part 310 so that the first cutting part 310 moves to be inclined upward in the approaching direction to the second cutting part 320 while in contact with the second cutting part 320.

The pressing force providing part 330 may include a contact part 332 configured to come into contact with the first cutting part 310 and an elastic part 334 configured to provide a pressing force so that the contact part 332 is in contact with the first cutting part 310, and may further include a movement guide part 336 configured to guide movement of the contact part 332 (see FIG. 5).

Specifically, the movement guide part 336 may be fixed to the second case 304 and may have the elastic part 334, which is a type of a spring, inserted thereinto to support the elastic part 334. The contact part 332 may be vertically moved along the movement guide part 336.

The contact part 332 may remain in contact with the first cutting part 310 by the elastic part 334 mounted on the movement guide part 336. The elastic part 334 may be elastically deformed when the first cutting part 310 is in contact with the second cutting part 320 and may maintain the contact between the contact part 332 and the first cutting part 310 by a restoring force caused by the elastic deformation.

As described above, when the first cutting part 310 is moved toward the second cutting part 320 to cut the boundary between the first area R1 and the second area R2, the first cutting part 310 may be obliquely moved upward while in contact with the second cutting part 320 by the pressing force providing part 330. Thus, an adequate contact pressure is acted between the first cutting part 310 and the second cutting part 320, and accuracy of cutting may be guaranteed.

Meanwhile, the recording paper cutting device 30 according to the present invention may include a movement detection part 340 configured to detect movement of the first cutting part 310 to enable information on whether the boundary between the first area R1 and the second area R2 is cut by an interaction between the first cutting part 310 and the second cutting part 320 to be acquired (see FIGS. 4 and 5).

The movement detection part 340 may be a type of a target of detection that is detected by a sensor 301 mounted at an upper surface of the first case 302. Conversely, when a target of detection is mounted on the upper surface of the first case 302, the movement detection part 340 may be a sensor.

It has been described above that the boundary between the first area R1 and the second area R2 is cut when the third gear G3 rotates by the driving force provided by the driving force providing part D and the first cutting part 310 moves in a straight line toward the second cutting part 320.

This is a case in which the first cutting part 310 has completely passed through a perforated line forming space S3 toward the second cutting part 320 as illustrated in FIG. 10. When the first cutting part 310 has moved toward the second cutting part 320 only up to a part in front of the perforated line forming space S3 or has not completely passed through the perforated line forming space S3 as illustrated in FIG. 9, a perforated line may be formed at the boundary.

The perforated line forming space S3 is a type of a space provided in the first cutting part 310 and may be formed at a substantially central portion of the first cutting part 310.

Whether the boundary between the first area R1 and the second area R2 is cut or a perforated line is formed at the boundary may be determined according to a rotational angle of the third gear G3, and the rotational angle may be properly controlled by a controller (not illustrated).

Meanwhile, recording papers that may be used for the printing device may include recording papers having an adhesive applied on one surface thereof. An adhesive applied on one surface of a recording paper becomes a cause of degrading cutting performance.

Here, the one surface of the recording paper on which an adhesive is applied may be one surface facing a fixed cutter side.

A movable cutter and a fixed cutter used in a printing device are polished in angles opposite from each other. A recording paper is cut by blades formed at opposite angles coming into contact with each other.

Here, due to repeated movements of the movable cutter, an adhesive applied on one surface of a recording paper may be accumulated on the movable cutter. This causes degradation of cutting performance.

The above problem is related to an area of a cutting surface for performing cutting, and an area of a cutting surface should be reduced to solve the above problem.

For this, as illustrated in FIG. 11, the first cutting part 310 provided in the recording paper cutting device 30 according to the present invention may include a first cutting surface 312 formed to be inclined by a first angle in the departing direction from the second cutting part 320 and a second cutting surface 314 configured to extend from the first cutting surface 312 and formed to be inclined by a second angle in the departing direction from the second cutting part 320.

Also, a normal vector V1 of the first cutting surface 312 and a normal vector V2 of the second cutting surface 314 may intersect (C) in a space corresponding to an upstream side of a position at which the boundary is cut.

The first cutting surface 312 may be formed to be inclined upward by the first angle in the departing direction from the second cutting part 320, and the second cutting surface 314 may extend from the first cutting surface 312 and may be formed to be inclined upward by the second angle, which is smaller than the first angle, in the departing direction from the second cutting part 320.

According to another aspect, the first cutting part 310 may include a first cutting surface 312 configured to increase a gap between the first area R1 and the second area R2 by a first rate of increase and a second cutting surface 314 configured to increase the gap by a second rate of increase according to a degree of movement of the first cutting part 310 in the approaching direction to the second cutting part 320.

Also, the second rate of increase may be smaller than the first rate of increase.

According to still another aspect, the first cutting part 310 may include a first cutting surface 312 formed to be obliquely inclined upward by the first angle in the departing direction from the second cutting part 320 and the second cutting surface 314 configured to extend from the first cutting surface 312 and formed to be inclined upward by a second angle, which is smaller than the first angle, in the departing direction from the second cutting part 320.

A width of the second cutting surface 314 in the departing direction from the second cutting part 320 may be larger than a width of the first cutting surface 312 in the departing direction from the second cutting part 320.

Also, a width of the second cutting surface 314 in a feeding direction of the first area R1 may be larger than a width of the first cutting surface 312 in the feeding direction of the first area R1.

As described above, since the first cutting surface 312 is realized by a portion of the width of the first cutting part 310 in the feeding direction of the first area R1 and the second cutting surface 314 is realized by the remaining portion of the width of the first cutting part 310, probability of an adhesive applied on one surface of the first area R1 being accumulated on the first cutting surface 312, which has a relatively smaller area, can be minimized, and a service life of the printing device 1 according to the present invention can be maximized.

Meanwhile, in addition to being engaged with the second gear G2, the first gear G1 is also engaged with a fourth gear G4 (see FIGS. 4 and 5). The fourth gear G4 may be an element capable of manually rotating the first gear G1 when power supply is unexpectedly cut off.

When the fourth gear G4 is manually rotated, the first gear G1 may also rotate, and an abnormal tangling of the first cutting part 310 and the first area R1 may be untangled. Since this is a known art, a detailed description thereof will be omitted.

Figure 12:
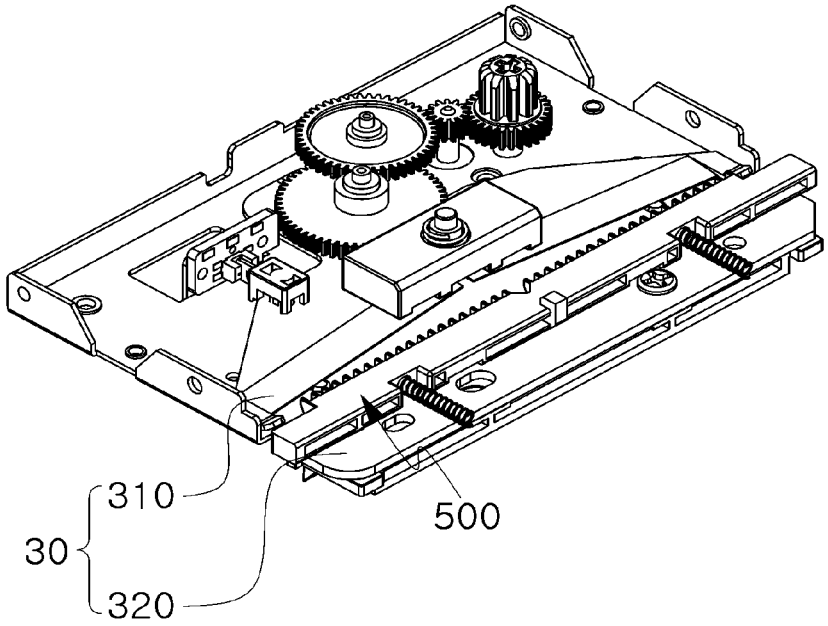
FIG. 12 is a schematic perspective view for describing an attachment preventing part provided in the printing device according to the present invention.
Figure 13:
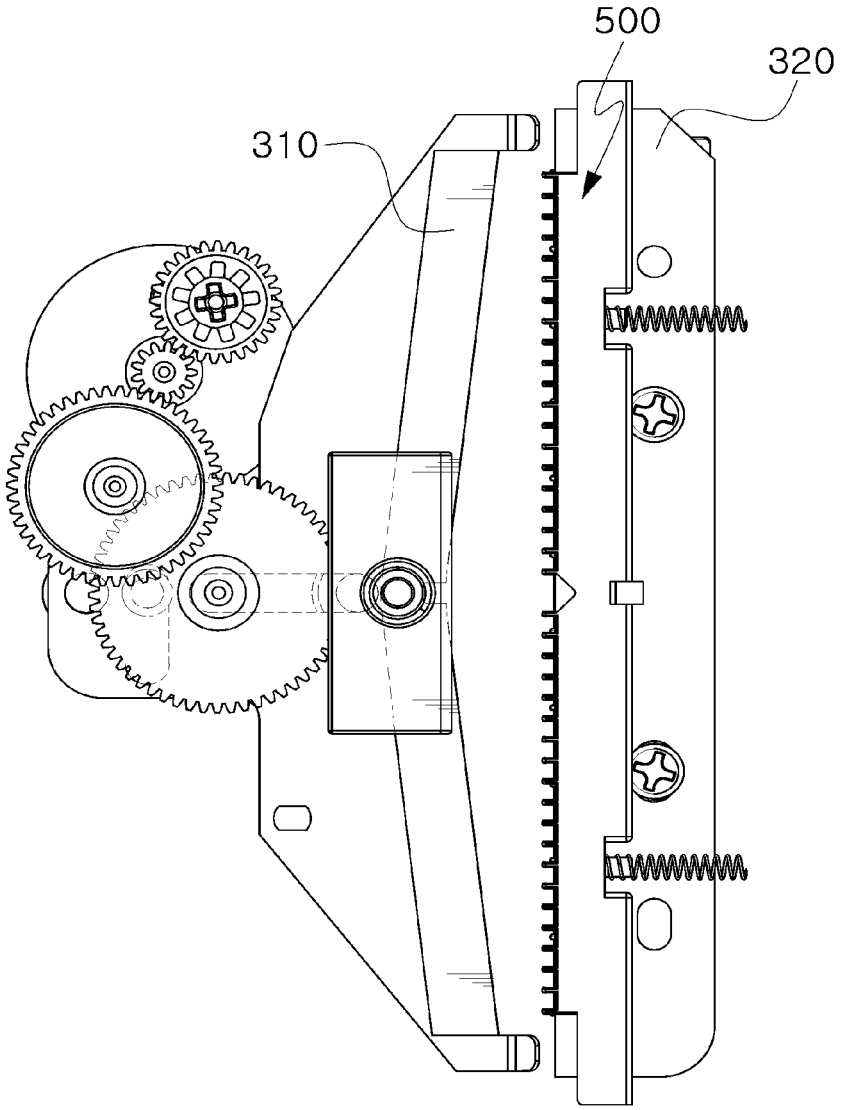
FIGS. 13 and 14 are views for describing a relation of positions of the attachment preventing part and perforating parts provided in the printing device according to the present invention.
Figure 14:
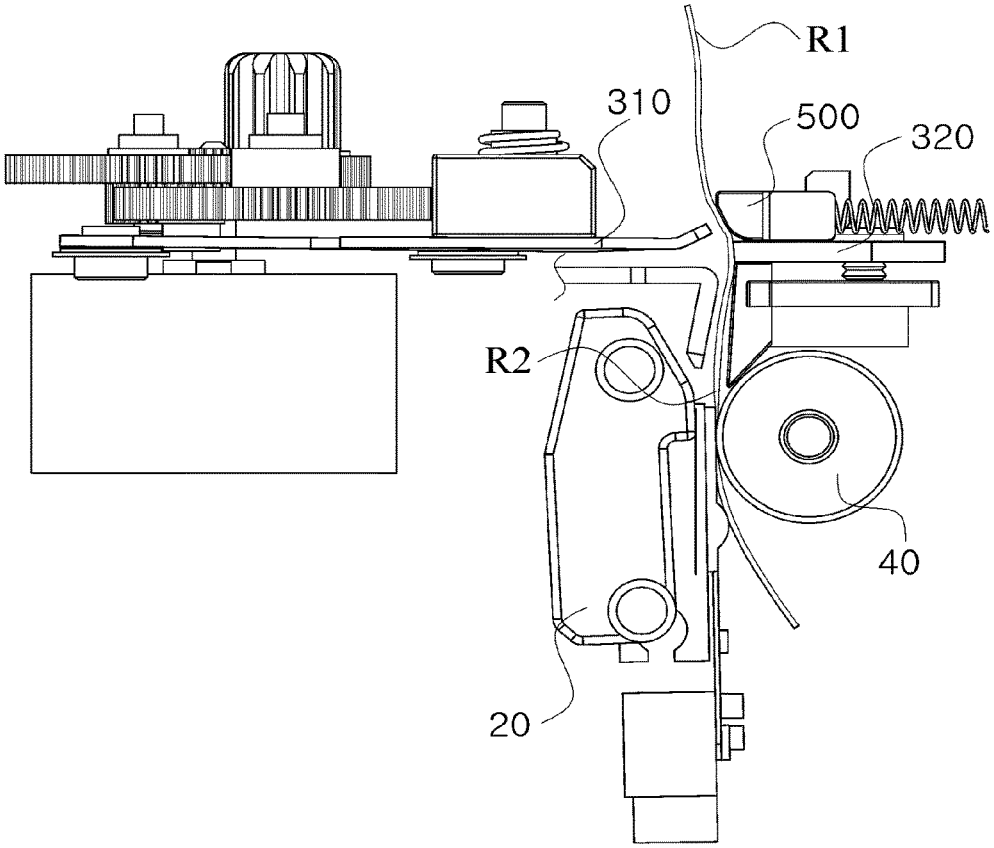
Figure 15:
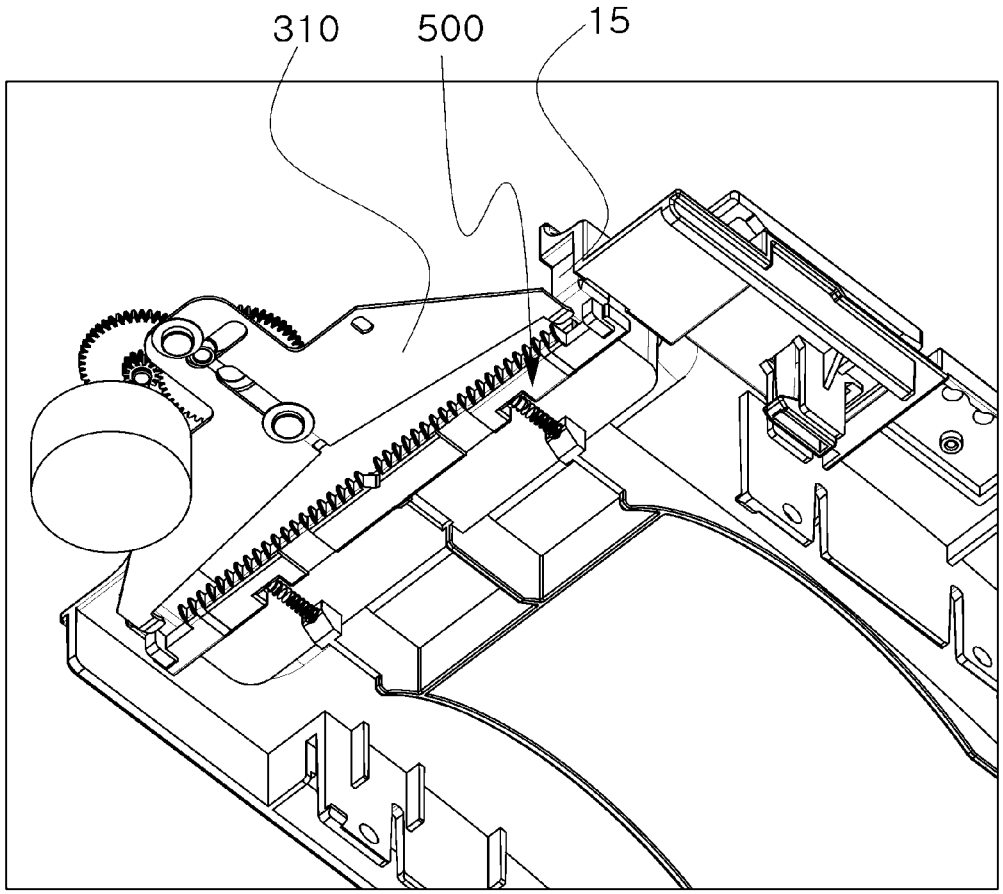
FIG. 15 is a view for describing a coupling structure of the attachment preventing part provided in the printing device according to the present invention.

FIG. 12 is a schematic perspective view for describing an attachment preventing part provided in the printing device according to the present invention, FIGS. 13 and 14 are views for describing a relation of positions of the attachment preventing part and perforating parts provided in the printing device according to the present invention, and FIG. 15 is a view for describing a coupling structure of the attachment preventing part provided in the printing device according to the present invention.

Referring to FIGS. 1, 2, 12 to 15, the printing device 1 according to the present invention may include the main body part 10, the cover part 15, the feeding part 40, the printing part 20, and the cutting part 30 describe above.

Here, the cutting part 30 may cut the boundary between the first area R1 of the recording paper R0 and the second area R2 thereof or enable a perforated line to be formed at the boundary. Hereinafter, a case in which a perforated line is formed at the boundary will be described as an example.

Consequently, hereinafter, a description will be given by using a different term, a perforating part 30, to refer to the cutting part 30.

The perforating part 30 may include a first perforating part 310 and a second perforating part 320, and the first perforating part 310 and the second perforating part 320 may respectively correspond to the first cutting part 310 and the second cutting part 320, which are described above.

The first perforating part 310 and the second perforating part 320 may be elements that form a perforated line at a boundary between a first area R1 of a recording paper R0 printed with a first piece of information and a second area R2 thereof disposed at an upstream side with respect to the first area R1 by being moved in an approaching direction or a departing direction from a downstream side of the printing part 20 so that the first area R1 is perforated and separated from the second area R2.

Here, the printing device 1 according to the present invention may include an attachment preventing part 500 configured to prevent performance of feeding the second area R2 from being degraded due to an adhesive applied on the second area R2, when the second area R2 of the recording paper R0 is being fed by the feeding part 40 after a perforated line is formed at the boundary between the first area R1 and the second area R2.

Prior to giving a detailed description of the attachment preventing part 500, problems related to a typical printing device without the attachment preventing part 500 will be briefly described with reference to the drawings of the present invention.

In a case of a recording paper having an adhesive applied on one surface thereof, after a perforated line is formed between the first area R1 and the second area R2 by an interaction between the first perforating part 310 and the second perforating part 320, one surface of the second area R2 on which an adhesive is applied may come into contact with the second perforating part 320. This may cause a phenomenon in which the second area R2 is adhered to the second perforating part 320.

When the second area R2 is adhered to the second perforating part 320, there may be a problem in feeding in a case of feeding the second area R2 by the feeding part 40 afterwards. Eventually, a recording paper jam phenomenon may occur.

To solve the above problems, the present invention may include the attachment preventing part 500. The attachment preventing part 500 may press the first area R1 to prevent performance of feeding the recording paper R0 by the feeding part 40 from degrading due to the recording paper R0 being attached to at least one of the first perforating part 310 and the second perforating part 320 by an adhesive applied on the second area R2.

Specifically, the attachment preventing part 500 may be slidably disposed at an upper side of the second perforating part 320 and may protrude more forward past the second perforating part 320 and be in contact with the first area R1 before a perforated line is formed, i.e., before the first perforating part 310 is moved to form a perforated line at a boundary between the first area R1 and the second area R2.

Figure 16:
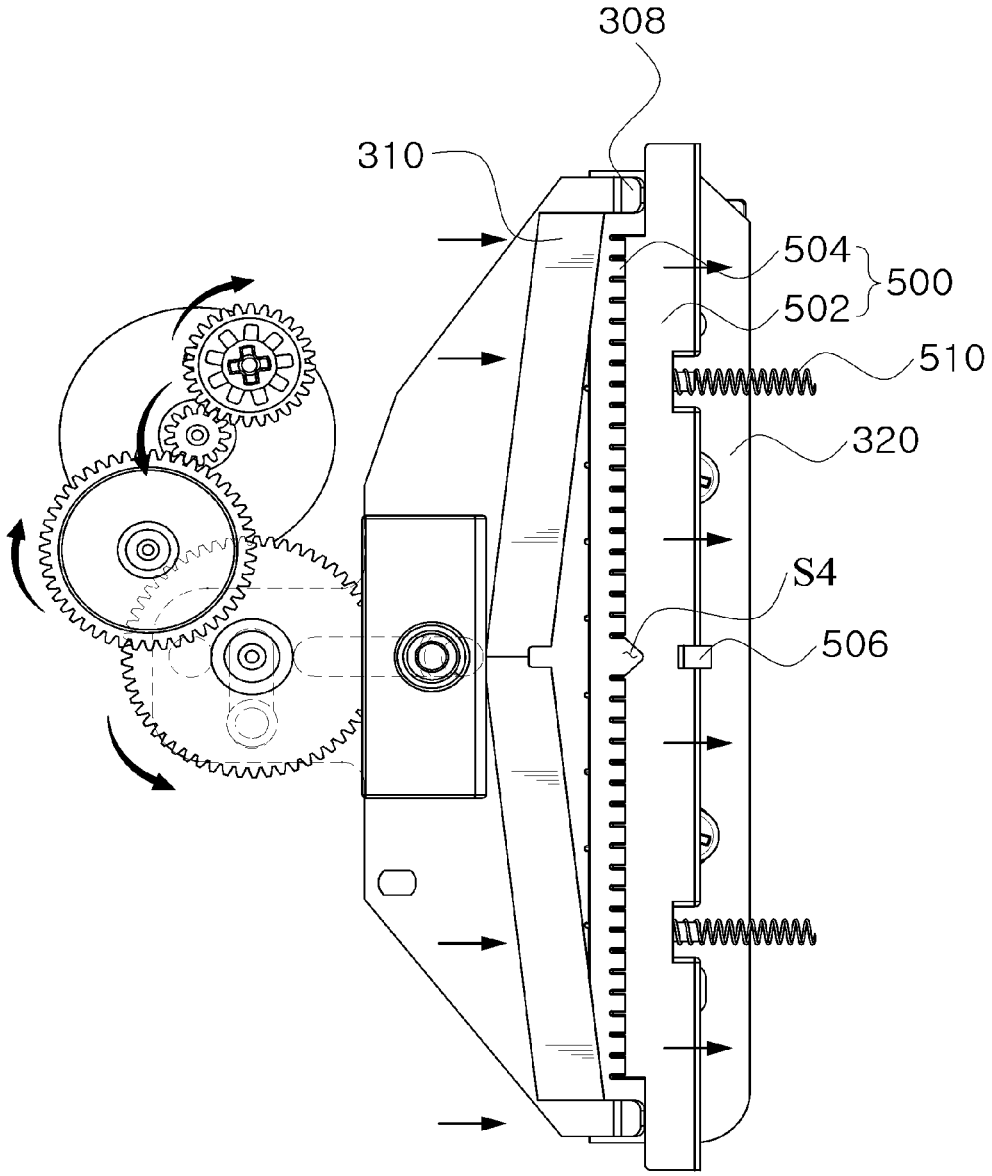
FIGS. 16 to 18 are views for describing a process in which the attachment preventing part provided in the printing device according to the present invention is moved by a first perforating part.
Figure 17:
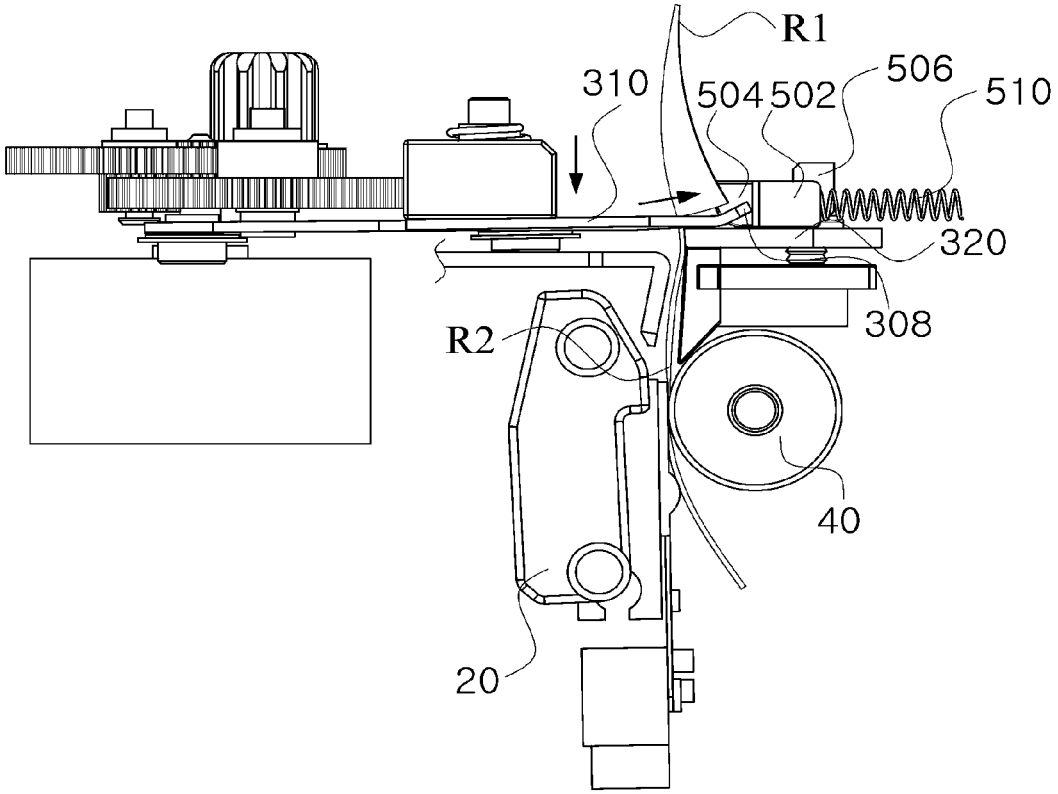
Figure 18:
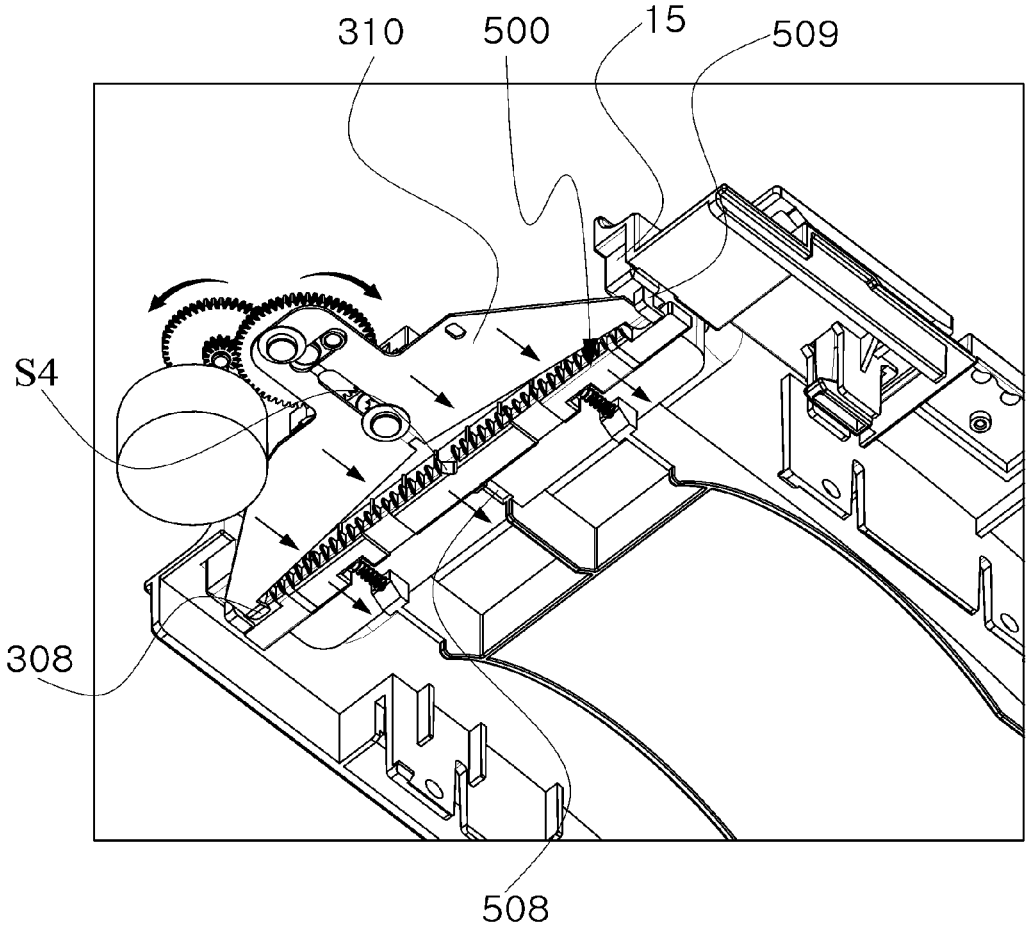
Figure 19:
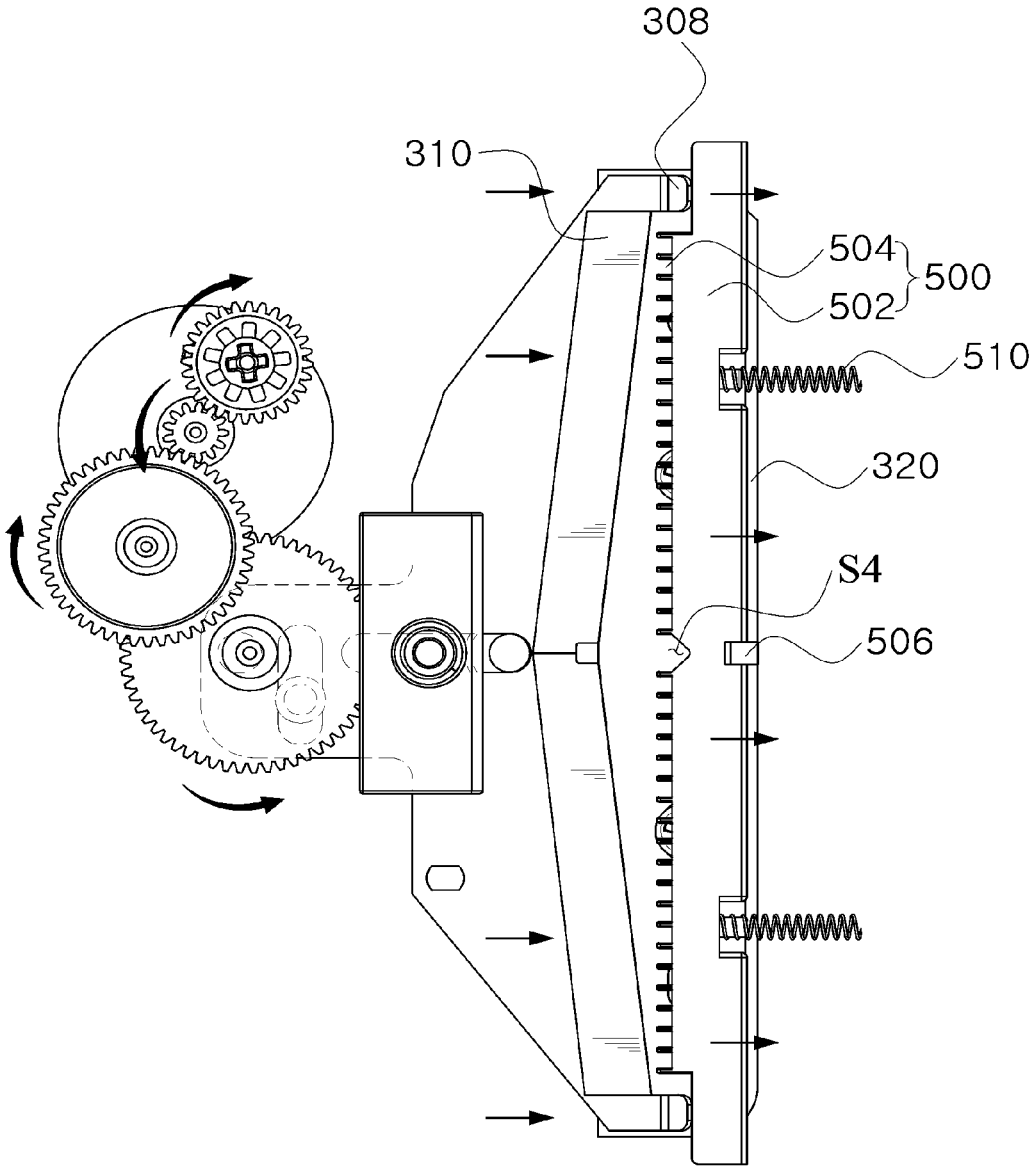
FIGS. 19 to 21 are views for describing a position of the attachment preventing part provided in the printing device according to the present invention, right after a perforated line is formed at a boundary between a first area and a second area.
Figure 20:
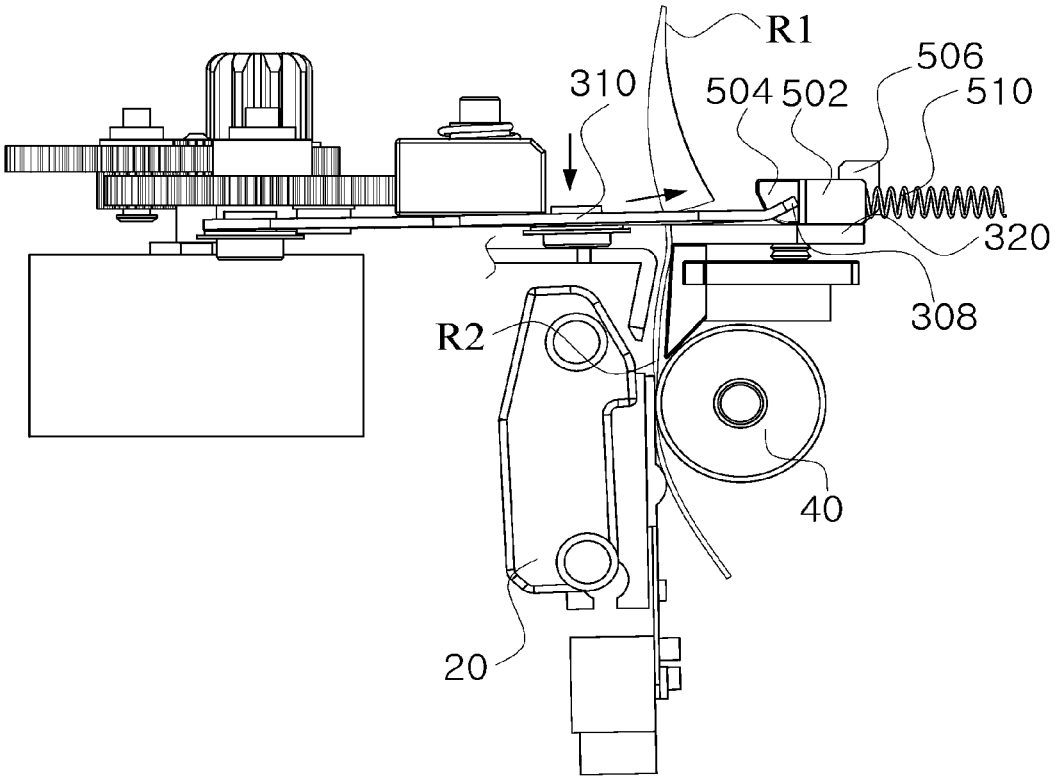
Figure 21:
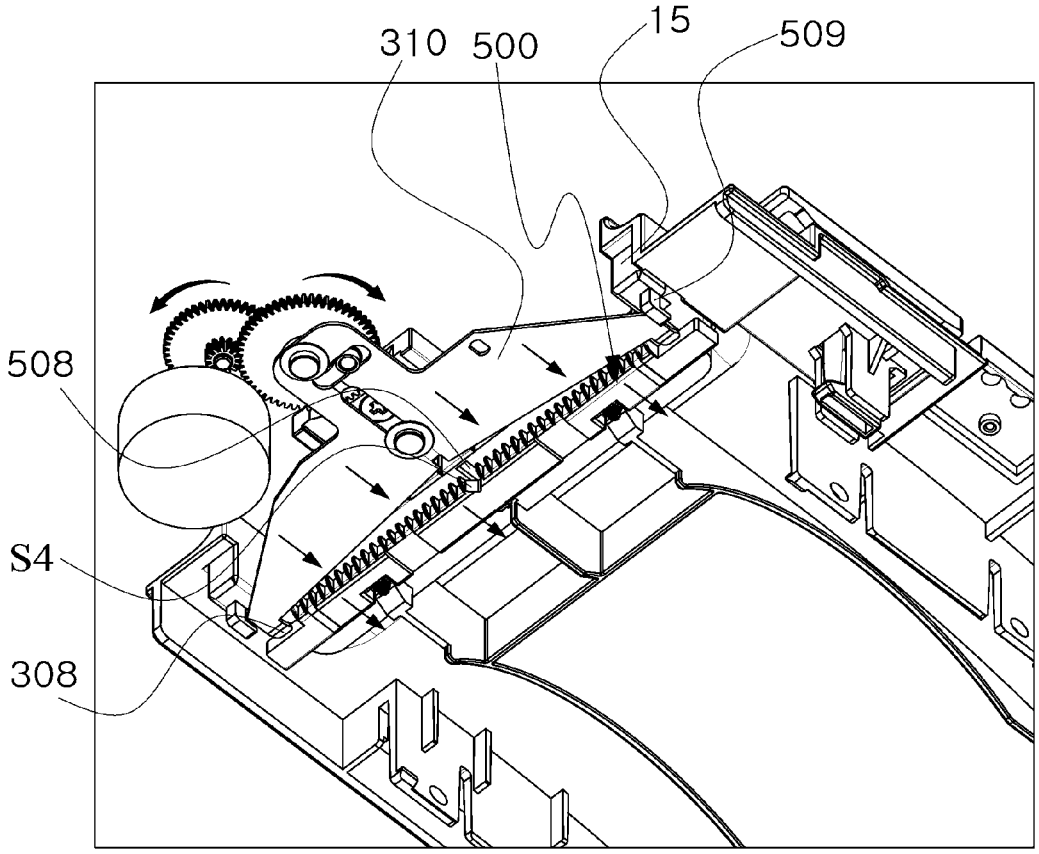

FIGS. 16 to 18 are views for describing a process in which the attachment preventing part provided in the printing device according to the present invention is moved by a first perforating part, and FIGS. 19 to 21 are views for describing a position of the attachment preventing part provided in the printing device according to the present invention, right after a perforated line is formed at a boundary between a first area and a second area.

Figure 22:
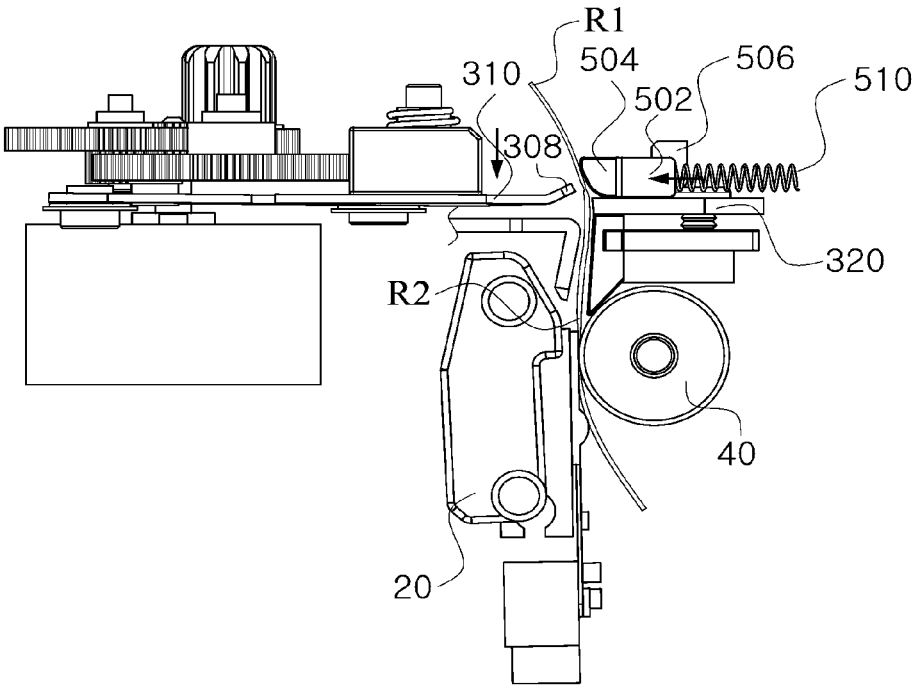
FIG. 22 is a view for describing a situation in which the second area is spaced apart from a second perforating part by the attachment preventing part provided in the printing device according to the present invention.

Also, FIG. 22 is a view for describing a situation in which the second area is spaced apart from a second perforating part by the attachment preventing part provided in the printing device according to the present invention.

As illustrated in FIGS. 16 to 18, the attachment preventing part 500 provided in the printing device 1 according to the present invention may be moved by interlocking with at least one of the first perforating part 310 and the second perforating part 320. Specifically, when the first perforating part 310 moves toward the second perforating part 320 to form a perforated line at a boundary between the first area R1 and the second area R2, the attachment preventing part 500 may be moved by interlocking with the first perforating part 310.

In other words, the attachment preventing part 500 may come into contact with the cutting guide part 308 formed at both ends of the first perforating part 310 to interlock with the first perforating part 310, may be moved backward by the first perforating part 310 when the first perforating part 310 is moved in the approaching direction to the second perforating part 320, and may press the first area R1 after moving forward and being restored to its original position when the first perforating part 310 is restored to its original position as illustrated in FIG. 22 after the perforated line is formed at the boundary as illustrated in FIGS. 19 to 21.

Here, when the attachment preventing part 500 is moved backward by the first perforating part 310, a position at which the attachment preventing part 500 comes into contact with the first perforating part 310 may be changed.

This is because the first perforating part 310 is obliquely moved upward when moving toward the second perforating part 320. Thus, the position at which the attachment preventing part 500 comes into contact with the first perforating part 310 may be moved upward.

Restoration of the attachment preventing part 500 to its original position may be realized by a restoring part 510 which is a type of a spring having an elastic force. The restoring part 510 may be elastically deformed when the attachment preventing part 500 is moved backward and may enable the attachment preventing part 500 to be restored to its original position by a restoring force caused by the elastic deformation when the first perforating part 310 is restored to its original position.

As illustrated in FIG. 22, the attachment preventing part 500 may apply an impact to the first area R1 as the attachment preventing part 500 is restored to its original position due to the restoration of the first perforating part 310 to its original position. Here, the attachment preventing part 500 may protrude more forward past the second perforating part 320 to prevent the second area R2 from coming into contact with the second perforating part 320.

Consequently, the second area R2 may be spaced apart from the second perforating part 320, and degradation of feeding performance may be prevented when the second area R2 is fed by the feeding part 40 afterwards.

When a coupling structure of the attachment preventing part 500 is examined more closely, the attachment preventing part 500 may be slidably mounted on the cover part 15.

For this, any one of the cover part 15 and the attachment preventing part 500 may include a guide part 506 formed to protrude so that the attachment preventing part 500 is slidably mounted on the cover part 15, and the other one of the cover part 15 and the attachment preventing part 500 may include an accommodation part 508 formed to be recessed to enable the guide part 506 to be accommodated therein to slide.

For example, as illustrated in the drawings, the accommodation part 508 may be disposed in the cover part 15, and the guide part 506 may be formed in the attachment preventing part 500. The numbers of the accommodation part 508 and the guide part 506 are not limited.

When the attachment preventing part 500 is restored to its original position due to the first perforating part 310 being restored to its original position, further forward movement of the attachment preventing part 500 may be blocked by a stopper 509 formed in the cover part 15.

Meanwhile, the attachment preventing part 500 may include a body part 502 and a protruding part 504 that protrudes from the body part 502 toward the first area R1 while being spaced apart from the first area R1 to come into contact with first area R1.

The protruding part 504 may be an element for minimizing a contact area with the first area R1 for minimizing adhesion between the first area R1 and the attachment preventing part 500 caused by an adhesive applied on one surface of the first area R1.

The attachment preventing part 500 may include a cutting preventing space S4 configured not to come into contact with the boundary between the first area R1 and the second area R2 of the perforated line to prevent cutting of the boundary when the first area R1 is pressed.

By the cutting preventing space S4, the perforated line formed at the boundary between the first area R1 and the second area R2 may be maintained without a change even when the attachment preventing part 500 presses the first area R1.

Meanwhile, the printing device 1 according to the present invention may maximize economic feasibility of recording papers by removing areas of the recording papers that cannot be printed and may include elements therefor.

Here, conventional problems will be briefly mentioned. In a case of a conventional printing device, a predetermined space is inevitably present between a printing part and a perforating part configured to form a perforated line at a boundary between a first area and a second area. Thus, an area of a recording paper disposed in the predetermined space inevitably becomes a margin on which nothing can be printed.

To solve such a problem, conventionally, a margin on which nothing can be printed is removed by reversely feeding an area of a recording paper provided between a printing part and a perforated line to the printing part. However, this also causes another problem.

That is, when a perforated line is formed by the perforating parts, a part at which the first area is separated from the second area is bent with respect to a part at which the first area and the second area are connected to each other. Thus, when the first area is reversely fed, there is a problem in that the first area is cut without normally passing through a gap between the perforating parts.

To solve the above problems, the present invention includes a feeding guide part configured to enable the first area to stably pass through a gap between the perforating parts despite bending of the first area when the first area is reversely fed.

The feeding guide part provided in the printing device 1 according to the present invention presses the first area to enable the first area to stably pass through a gap between the perforating parts in a process of reversely feeding the first area after a perforated line is formed at the boundary between the first area and the second area.

Any element capable of pressing the first area and flattening the bent first area after the perforated line is formed may be employed as the feeding guide part that may be included in the printing device 1 according to the present invention. For example, the feeding guide part may be realized by an element like the attachment preventing part 500 that has been described with reference to FIGS. 12 to 22.

Hereinafter, the attachment preventing part 500 described with reference to FIGS. 12 to 22 is described as a substitute for the feeding guide part provided in the printing device 1 according to the present invention.

The printing device 1 according to the present invention may include the main body part 10, the cover part 15, the feeding part 40, the printing part 20, the perforating part 30, and the feeding guide part 500.

The perforating part 30 may include the first perforating part 310 and the second perforating part 320 configured to form a perforated line at a boundary between the first area R1 and the second area R2 by being moved in an approaching direction to or a departing direction from each other at a downstream side spaced a predetermined distance apart from the printing part 20 so that the first area R1 of the recording paper R0 printed with a first piece of information is separated from the second area R2 of the recording paper R0 disposed at an upstream side with respect to the first area R1.

Here, when a perforated line is formed at the boundary between the first area R1 and the second area R2 by the first perforating part 310 and the second perforating part 320, the feeding part 40 may feed, i.e., reversely feed, the second area R2 toward the printing part 20 so that an area of the second area R2 adjacent to the perforated line provided between the printing part 20 and the perforated line is printed with a second piece of information by the printing part 20.

When the second area R2 is being fed toward the printing part 20 by the feeding part 40, the feeding guide part 500 may be disposed at a downstream side of the first perforating part 310 and the second perforating part 320 so that the first area R1 is pressed and the first area R1 passes through a gap between the first perforating part 310 and the second perforating part 320.

Specifically, the feeding guide part 500 may be slidably disposed at an upper side of the second perforating part 320 and may be disposed to protrude more forward past the second perforating part 320 to come into contact with the first area R1 before the perforated line is formed, i.e., before the first perforating part 310 is moved to form the perforated line at the boundary between the first area R1 and the second area R2.

As illustrated in FIGS. 16 to 18, the feeding guide part 500 provided in the printing device 1 according to the present invention may be moved by interlocking with at least one of the first perforating part 310 and the second perforating part 320. Specifically, the feeding guide part 500 may be moved by interlocking with the first perforating part 310 when the first perforating part 310 is moved toward the second perforating part 320 to form a perforated line at the boundary between the first area R1 and the second area R2.

In other words, the feeding guide part 500 may interlock with the first perforating part 310 by coming into contact with the cutting guide part 308 formed at both ends of the first perforating part 310, may be moved backward by the first perforating part 310 when the first perforating part 310 is moved in the approaching direction to the second perforating part 320, and may press the first area R1 after moving forward and being restored to its original position when the first perforating part 310 is restored to its original position as illustrated in FIG. 22 after the perforated line is formed at the boundary as illustrated in FIGS. 19 to 21.

Here, when the feeding guide part 500 is moved backward by the first perforating part 310, a position at which the feeding guide part 500 comes into contact with the first perforating part 310 may be changed.

This is because the first perforating part 310 is obliquely moved upward when moving toward the second perforating part 320. Thus, the position at which the feeding guide part 500 comes into contact with the first perforating part 310 may be moved upward.

Restoration of the feeding guide part 500 to its original position may be realized by a restoring part 510 which is a type of a spring having an elastic force. The restoring part 510 may be elastically deformed when the feeding guide part 500 is moved backward and may enable the feeding guide part 500 to be restored to its original position by a restoring force caused by the elastic deformation when the first perforating part 310 is restored to its original position.

As illustrated in FIG. 22, the feeding guide part 500 may apply an impact to the first area R1 as the feeding guide part 500 is restored to its original position due to the restoration of the first perforating part 310 to its original position. Here, the feeding guide part 500 presses an area including both ends of the first area R1 in the width direction.

Figure 23:
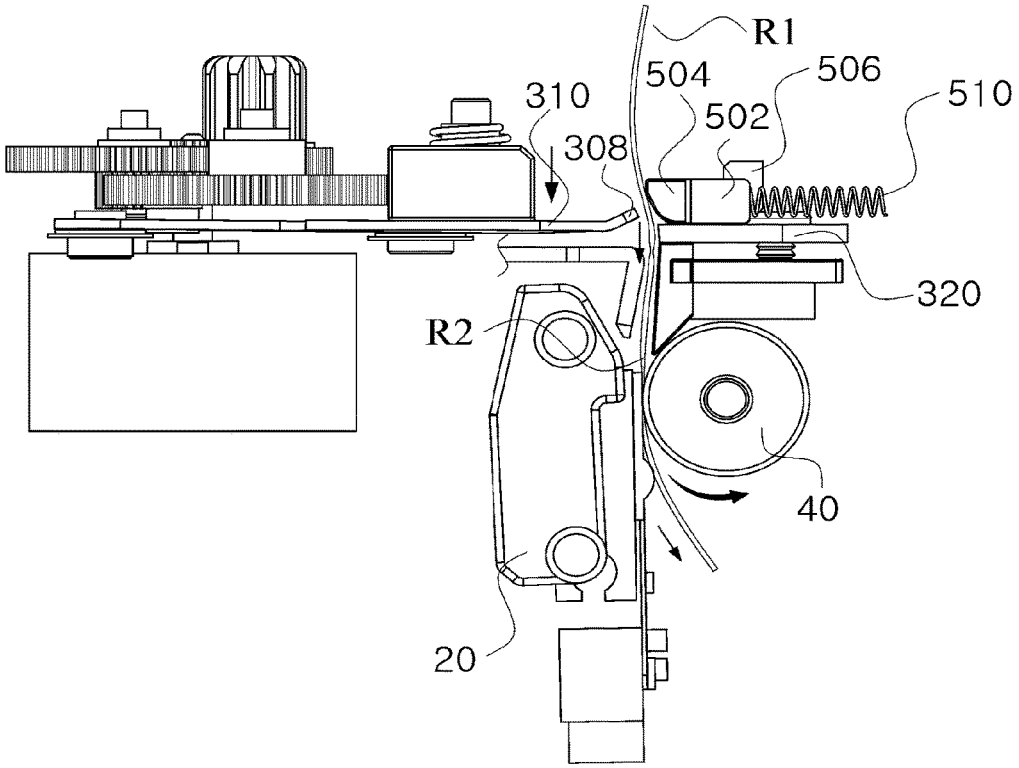
FIG. 23 is a view for describing a situation in which the first area passes through a gap between the first perforating part and the second perforating part by a feeding guide part provided in the printing device according to the present invention.

Here, FIG. 23 is a view for describing a situation in which the first area passes through a gap between the first perforating part and the second perforating part by a feeding guide part provided in the printing device according to the present invention. When the first area R1 is reversely fed as illustrated in FIG. 23, the first area R1 stably passes through a gap between the first perforating part 310 and the second perforating part 320 without damage to the perforated line despite the first area R1 being bent.

When a coupling structure of the feeding guide part 500 is examined more closely, the feeding guide part 500 may be slidably mounted on the cover part 15.

For this, any one of the cover part 15 and the feeding guide part 500 may include a guide part 506 formed to protrude so that the feeding guide part 500 is slidably mounted on the cover part 15, and the other one of the cover part 15 and the feeding guide part 500 may include an accommodation part 508 formed to be recessed to enable the guide part 506 to be accommodated therein to slide.

For example, as illustrated in the drawings, the accommodation part 508 may be disposed in the cover part 15, and the guide part 506 may be formed in the feeding guide part 500. The numbers of the accommodation part 508 and the guide part 506 are not limited.

When the feeding guide part 500 is restored to its original position due to the first perforating part 310 being restored to its original position, further forward movement of the feeding guide part 500 may be blocked by a stopper 509 formed in the cover part 15.

Meanwhile, the feeding guide part 500 may include a concavo-convex portion to minimize attachment of an adhesive applied on one surface of the first area R1 when the feeding guide part 500 comes into contact with the first area R1.

Specifically, the feeding guide part 500 may include a body part 502 and a protruding part 504 that protrudes from the body part 502 toward the first area R1 while being spaced apart from the first area R1 to come into contact with first area R1.

That is, the protruding part 504 may be an element for minimizing a contact area with the first area R1 for minimizing adhesion between the first area R1 and the feeding guide part 500 caused by an adhesive applied on one surface of the first area R12.

The feeding guide part 500 may include a cutting preventing space S4 configured not to come into contact with a portion of the perforated line at which the first area R1 and the second area R2 are connected to prevent cutting of the connected portion when the first area R1 is pressed.

By the cutting preventing space S4, the perforated line that divides the first area R1 from the second area R2 may be maintained without a change even when the feeding guide part 500 presses the first area R1.

According to the present invention, a recording paper cutting device and a printing device can prevent an adhesive from being accumulated on a cutting part in a repeated process of cutting or perforating recording papers.

Also, contact between a recording paper on which an adhesive is applied and the cutting part is prevented such that degradation of recording paper feeding performance is prevented.

Also, economic feasibility of recording papers can be maximized by removing areas of recording papers that cannot be printed.

Although configurations and features of the present invention have been described above based on embodiments according to the present invention, the present invention is not limited thereto, and it should be apparent to one of ordinary skill in the art to which the present invention pertains that the present invention may be modified and changed in various ways within the spirit and scope of the present invention. Consequently, it should be noted that such modifications and changes belong to the scope of the appended claims.

For example, being "inclined upward" which is mentioned above will be being "inclined downward" when the cutting part is realized in the opposite direction from the direction described above.

DESCRIPTION OF REFERENCE NUMERALS

1: Printing device
10: Main body part
15: Cover part
20: Printing part
30: Cutting part
40: Feeding part

What is claimed is:

1. A recording paper cutting device for cutting a boundary between a first area of a recording paper and a second area of the recording paper placed at an upstream side of the first area so that the first area is separately discharged from the second area after the first area is printed with a first piece of information, the recording paper cutting device comprising:

a first cutting part and a second cutting part, wherein:

at least one of the first cutting part and the second cutting part moves in an approaching direction or a departing direction so that the boundary is cut;

the first cutting part includes a first cutting surface formed to be inclined by a first angle in the departing direction from the second cutting part and a second cutting surface configured to extend from the first cutting surface and formed to be inclined by a second angle, which is smaller than the first angle, in the departing direction from the second cutting part;

the first cutting part includes a facing surface which is facing the second cutting part when the at least one of the first cutting part and the second cutting part moves in the approaching direction so that the boundary is cut; and the first cutting surface and the second cutting surface are formed at the other side of the first cutting part from which the facing surface is formed.

2. The recording paper cutting device of claim 1, wherein a width of the second cutting surface in the departing direction from the second cutting part is larger than a width of the first cutting surface in the departing direction from the second cutting part.

3. The recording paper cutting device of claim 1, wherein a width of the second cutting surface in a feeding direction of the first area is larger than a width of the first cutting surface in the feeding direction of the first area.

4. The recording paper cutting device of claim 1, wherein the first cutting part moves in the approaching direction to the second cutting part so that the boundary is cut and is obliquely moved in the approaching direction to the second cutting part due to contact with the second cutting part.

5. The recording paper cutting device of claim 4, further comprising a pressing force providing part configured to provide a pressing force to the first cutting part so that the first cutting part is obliquely moved in the approaching direction to the second cutting part while in contact with the second cutting part.

6. The recording paper cutting device of claim 5, wherein:

the pressing force providing part includes a contact part configured to come into contact with the first cutting part and an elastic part configured to provide a pressing force so that the contact part is in contact with the first cutting part; and the elastic part is elastically deformed when the first cutting part is in contact with the second cutting part and, when the contact is released, maintains the contact between the contact part and the first cutting part by a restoring force caused by the elastic deformation.

7. The recording paper cutting device of claim 1, further comprising:

a driving force providing part configured to provide a driving force for moving the first cutting part; and a driving force transmitting part configured to rotate by the driving force so that the driving force is transmitted to the first cutting part, wherein:

the driving force transmitting part includes an eccentric part that is eccentrically protruding;

the first cutting part includes a deviating part formed to be deviated from a center to accommodate the eccentric part so that the first cutting part is moved in the approaching direction to or the departing direction from the second cutting part by rotation of the eccentric part; and the recording paper cutting device further comprises a stiffness reinforcing part mounted on the eccentric part and accommodated in the deviating part to reinforce a stiffness of the eccentric part.

8. The recording paper cutting device of claim 1, further comprising a movement detection part configured to detect movement of the first cutting part to enable information on whether the boundary is cut by an interaction between the first cutting part and the second cutting part to be acquired.

9. The recording paper cutting device of claim 1, wherein a normal vector of the first cutting surface intersects with a normal vector of the second cutting surface in a space corresponding to an upstream side of a position at which the boundary is cut.

10. A recording paper cutting device for cutting a boundary between a first area of a recording paper and a second area of the recording paper placed at an upstream side of the first area so that the first area is separately discharged from the second area after the first area is printed with a first piece of information, the recording paper cutting device comprising:

a first cutting part and a second cutting part, wherein:

at least one of the first cutting part and the second cutting part moves in an approaching direction or a departing direction so that the boundary is cut;

the first cutting part includes a first cutting surface configured to increase a gap between the first area and the second area by a first rate of increase and a second cutting surface configured to increase the gap by a second rate of increase depending on a degree in which the first cutting part is moved in the approaching direction to the second cutting part;

the first cutting part includes a facing surface which is facing the second cutting part when the at least one of the first cutting part and the second cutting part moves in the approaching direction so that the boundary is cut; and the first cutting surface and the second cutting surface are formed at the other side of the first cutting part from which the facing surface is formed.

11. The recording paper cutting device of claim 10, wherein the second rate of increase is smaller than the first rate of increase.

12. A printing device comprising:

a main body part configured to provide a predetermined inner space;

a printing part configured to print a first area of a recording paper disposed in the inner space with a first piece of information; and a cutting part configured to cut a boundary between the first area of the recording paper and a second area of the recording paper placed at an upstream side of the first area so that the first area is separately discharged from the second area, wherein:

the cutting part includes a first cutting part and a second cutting part;

at least one of the first cutting part and the second cutting part moves in an approaching direction or a departing direction so that the boundary is cut;

the first cutting part includes a first cutting surface configured to increase a gap between the first area and the second area by a first rate of increase and a second cutting surface configured to increase the gap by a second rate of increase depending on a degree in which the first cutting part is moved in the approaching direction to the second cutting part;

the first cutting part includes a facing surface which is facing the second cutting part when the at least one of the first cutting part and the second cutting part moves in the approaching direction so that the boundary is cut; and the first cutting surface and the second cutting surface are formed at the other side of the first cutting part which the facing surface is formed.

13. The printing device of claim 12, wherein the second rate of increase is smaller than the first rate of increase.

14. The printing device of claim 12, wherein:

the first cutting surface is formed to be inclined by a first angle in the departing direction from the second cutting part; and the second cutting surface is formed to be inclined by a second angle, which is smaller than the first angle, in the departing direction from the second cutting part.

15. The printing device of claim 12, wherein a width of the second cutting surface in the departing direction from the second cutting part is larger than a width of the first cutting surface in the departing direction from the second cutting part.

16. The printing device of claim 12, wherein a width of the second cutting surface in a feeding direction of the first area is larger than a width of the first cutting surface in the feeding direction of the first area.

17. The printing device of claim 12, wherein the first cutting part moves in the approaching direction to the second cutting part so that the boundary is cut and may be obliquely moved in the approaching direction to the second cutting part due to contact with the second cutting part.

18. The printing device of claim 17, further comprising a pressing force providing part configured to provide a pressing force to the first cutting part so that the first cutting part is obliquely moved in the approaching direction to the second cutting part while in contact with the second cutting part.

19. The printing device of claim 18, wherein:

the pressing force providing part includes a contact part configured to come into contact with the first cutting part and an elastic part configured to provide a pressing force so that the contact part is in contact with the first cutting part; and the elastic part is elastically deformed when the first cutting part is in contact with the second cutting part and, when the contact is released, maintains the contact between the contact part and the first cutting part by a restoring force caused by the elastic deformation.

20. The printing device of claim 12, further comprising:

a driving force providing part configured to provide a driving force for moving the first cutting part; and a driving force transmitting part configured to rotate by the driving force so that the driving force is transmitted to the first cutting part, wherein:

the driving force transmitting part includes an eccentric part that is eccentrically protruding;

the first cutting part includes a deviating part formed to be deviated from a center to accommodate the eccentric part so that the first cutting part is moved in the approaching direction to or the departing direction from the second cutting part by rotation of the eccentric part; and the printing device further comprises a stiffness reinforcing part mounted on the eccentric part and accommodated in the deviating part to reinforce a stiffness of the eccentric part.

* * * * *